US009243624B2

(12) United States Patent
McNamara et al.

(10) Patent No.: US 9,243,624 B2
(45) Date of Patent: Jan. 26, 2016

(54) THERMALLY DRIVEN KNUDSEN PUMP

(75) Inventors: Shamus McNamara, Louisville, KY (US); Kunal Pharas, Louisville, KY (US)

(73) Assignee: University of Louisville Research Foundation, Inc., Louisville, KY (US)

( * ) Notice: Subject to any disclaimer, the term of this patent is extended or adjusted under 35 U.S.C. 154(b) by 828 days.

(21) Appl. No.: 13/502,411

(22) PCT Filed: Oct. 22, 2010

(86) PCT No.: PCT/US2010/053790
§ 371 (c)(1),
(2), (4) Date: Apr. 17, 2012

(87) PCT Pub. No.: WO2011/050285

PCT Pub. Date: Apr. 28, 2011

(65) Prior Publication Data

US 2012/0207625 A1 Aug. 16, 2012

Related U.S. Application Data

(60) Provisional application No. 61/296,901, filed on Jan. 21, 2010, provisional application No. 61/254,248, filed on Oct. 23, 2009.

(51) Int. Cl.
*F04B 19/04* (2006.01)
*F04B 37/06* (2006.01)

(Continued)

(52) U.S. Cl.
CPC ..... *F04B 43/043* (2013.01); *F04B 19/006* (2013.01); *F04B 19/24* (2013.01); *F04B 37/06* (2013.01)

(58) Field of Classification Search
CPC ..... F04B 19/006; F04B 19/24; F04B 37/06
USPC ..... 417/207
See application file for complete search history.

(56) References Cited

U.S. PATENT DOCUMENTS 6,533,554 B1 * 3/2003 Vargo et al. ..... 417/207
6,869,273 B2 3/2005 Crivelli (Continued)

OTHER PUBLICATIONS

K. Pharas and S. McNamara; "Knudsen pump driven by a thermoelectric material"; J. Micromech. Microeng; 2010; p. 125032; vol. 20.

(Continued)

*Primary Examiner* — Peter J Bertheaud
(74) *Attorney, Agent, or Firm* — Wyatt, Tarrant & Combs, LLP; Stephen C. Hall

(57) ABSTRACT

The present invention relates to thermally driven pumps. More specifically, one embodiment of the present invention relates to the use of a thermoelectric material to create a thermally driven, bi-directional pump, such as a micro pump, with no moving parts using the thermal transpiration effect (a Knudsen pump). One embodiment of the thermally driven pump of the present invention utilizes a thermoelectric material to assist with the thermal transpiration process resulting in a substantially symmetrical, bidirectional pump. A thermoelectric module is used to induce a temperature gradient across a nanoporous article having at least one nanochannel thus creating fluid flow via thermal transpiration across the nanochannel. The use of the thermoelectric module eliminates the need for a heat sink thereby making the pump substantially symmetrical and enabling bidirectional flow which is accomplished by reversing the polarity of the power supply to the thermoelectric module resulting in reversing the direction of heat transfer.

A second embodiment of the thermally driven pump of the present invention comprises a uni-directional, pneumatic, micro fluidic, Knudsen pump which can be integrated into a lab-on-chip device and is configured to pump liquids. The Knudsen pump of the second embodiment is generally comprised of a channel system comprised of a nanochannel and a shallow channel embedded in a bottom substrate and capable of alignment in series with other channels within a lab-on-chip substrate. The nanochannel and shallow channel are both covered by a second substrate comprised of material conducive to finalize creation of the Knudsen channels. A heater is also included within the nanochannel to induce gas flow by thermal transpiration which pneumatically moves liquid through the channels of a lab-on-chip.

7 Claims, 13 Drawing Sheets

(51) Int. Cl.

| | |
|---|---|
| ***F04B 43/04*** | (2006.01) |
| ***F04B 19/00*** | (2006.01) |
| ***F04B 19/24*** | (2006.01) |

(56) References Cited

U.S. PATENT DOCUMENTS

| | | | |
|---|---|---|---|
| 7,310,953 | B2 | 12/2007 | Pham et al. |
| 7,572,110 | B2 | 8/2009 | Bernard et al. |
| 8,057,446 | B2 | 11/2011 | Kane et al. |
| 2008/0015494 | A1 | 1/2008 | Santini et al. |
| 2008/0275409 | A1 | 11/2008 | Kane et al. |
| 2009/0175736 | A1 | 7/2009 | Gianchandani et al. |

OTHER PUBLICATIONS

Kunal Pharas and Shamus McNamara; Bi-Directional Gas Pump Driven by a Thermoelectric Material; Proceedings IEEE MEMS Conference; Jan. 2010; 4 pages; Hong Kong.

S. Miles, A. Bell, S. McNamara; "Solar Thermal Powered Knudsen Gas Pump"; Poster presented at 2011 Kentucky Statewide Workshop: Renewable Energy & Energy Efficiency; Mar. 13-15, 2011; Kentucky International Convention Center; Louisville, Kentucky, USA.

S. Miles, A. Bell, S. McNamara; "Solar Thermal Powered and Body Heat Powered Knudsen Gas Pump"; Workshop Booklet and Abstracts, 2011 Kentucky Statewide Workshop: Renewable Energy & Energy Efficiency; Mar. 13-15, 2011; p. 63; available at http://www.conncenter.net/lib/img/energy-education/Booklet2011.pdf; Kentucky International Convention Center; Louisville, Kentucky, USA.

Chiang, B.; Essick, E.; Ehringer, W.; Murphree, S.; Hauck, M.A..; Li, M.; Chien S.; Enhancing Skin Wound Healing by Direct Delivery of Intracellular Adenosine Triphosphate; American Journal of Surgery; 2007; 193(2); 213-8.

S. McNamara and Y.B. Gianchandani; "On-Chip Vacuum Generated by a Micromachined Knudsen Pump"; IEEE J. MEMS; 2005; pp. 741-746; vol. 14(4).

Chakravarthy Yamarthy, Kunai Pharas; Alexander Schultz and Shamus McNamara; "Pneumatic Pumping of Liquids Using Thermal Transpiration for Lab-on-a-Chip Applications"; Proceedings IEEE Sensors Conference; Oct. 25-29, 2009; pp. 1931-1934; Christchurch, New Zealand.

D. Copic, E. Brehob, S. McNamara; "Theoretical Efficiency of a Microfabricated Knudsen Pump"; Proceedings of University/Government/Industry Micro-Nano Symposium (UGIM); Jul. 13-16, 2008; 4 pages; Louisville, Kentucky, USA.

D. Copic and S. McNamara; "Efficiency Derivation for the Knudson Pump with and without Thermal Losses"; Journal of Vacuum Science and Technology A; 2009; pp. 496-502; v. 27, n.3.

S. Kar, S. McWhorter, S.M. Ford, and S.A. Soper; "Piezoelectric mechanical pump with nanoliter per minute pukse-free flow delivery for pressure pumping in micro-channels"; Analyst; 1998; 1435-1441; 123.

N. Cellar, S.T. Burns, J.C. Meiners, H. Chen, and R.T. Kennedy; "Microfluidic Chip for Low-Flow Push-Pull Perfusion Sampling in Vivo with On-Line Analysis of Amino Acids"; Anal. Chem.; 77; 2005; pp. 7067-7073.

M. Young, Y.L. Han; E.P. Muntz, and G. Shiflett; "Characterization and optimization of a radiantly driven multi-stage Knudsen compressor"; 24th International Symposium on Rarefied Gas Dynamics; 2005; pp. 174-179.

The United States Patent and Trademark Office; International Search Report and Written Opinion; Dec. 22, 2010; pp. 1-9; USA.

* cited by examiner

THERMALLY DRIVEN KNUDSEN PUMP

CROSS-REFERENCE TO RELATED APPLICATIONS

This application is a national stage of PCT/US10/53790 filed Oct. 22, 2010, which claims the benefit of U.S. Provisional Application 61/254,248 which was filed on Oct. 23, 2009 and U.S. Provisional Application 61/296,901 which was filed on Jan. 21, 2010, all of which are hereby incorporated by reference.

STATEMENT REGARDING FEDERALLY SPONSORED RESEARCH OR DEVELOPMENT

This invention was made with Government support under Grant Nos. ECS-0601453 and EPS-0814194, awarded by the National Science Foundation (NSF). The Government has certain rights in this invention.

REFERENCE TO A "MICROFICHE APPENDIX"

Not applicable

BACKGROUND OF THE INVENTION

The present invention relates to thermally driven pumps. More specifically, one embodiment of the present invention relates to the use of a thermoelectric material to create a thermally driven, bi-directional pump, such as a micro pump, with no moving parts using the thermal transpiration effect (a Knudsen pump). The thermally driven Knudsen pump of the present invention achieves high flow rates in both directions, is easy to fabricate, generates a continuous pneumatic pressure, and exhibits an increased pump efficiency over prior art Knudsen pumps. A second embodiment of the present invention relates to Knudsen pumps utilized on micro fluidics platforms, particularly Knudsen pumps integrated and configured within the substrate of lab-on-chip devices and further configured to pump liquids through channels also configured within the substrate of micro fluidic devices in response to pressure generated within the channels of the Knudsen pumps resulting from thermal transpiration.

Knudsen pumps on the macro scale operate at pressures lower than atmospheric pressures. Because micro scale Knudsen pumps operate at atmospheric pressure (pumps with channels having a hydraulic diameter of 100 nm or less), Knudsen pumps have recently been utilized in micro scale applications. Macro-scale Knudsen pumps can operate at atmospheric pressure so long as they contain channels with a hydraulic diameter of 100 nm or less.

Microtechnology is technology whose smallest feature is less than one millimeter in size. Micromechanical systems, sensors, actuators, and pumps, for example, are increasingly being utilized in microtechnology applications. For example, Micro-Electro-Mechanical Systems ("MEMS") refers to the integration of mechanical elements, sensors, actuators, pumps, and electronics on a common silicon substrate through micro fabrication technology. Fluid flow in microtechnology and MEMS applications is typically accomplished by external pressure sources, external mechanical pumps, or internal micro pumps.

For example, micro gas pumps find a variety of uses in microtechnology and MEMS ranging from gas manipulation, forced convective cooling, micro plasma, and gas chromatography to microfluidic applications like Lab-On-Chip, protein immunoassays and active micro mixers. In many applications such as filtration, by-pass medical devices, and micro total analysis systems, it is desired to have a pump that is bi-directional. Electrostatically actuated diaphragm pumps are commonly used micro pumps, but reliability can be a concern due to moving parts that are more prone to wear and tear, particularly in the micro scale.

Regarding micro fluidics platforms, micro fluidic devices have a tremendous potential in biomedical and chemical applications. They provide miniaturized platforms for fluidic handling, separation, mixing, dilution, etc. Some of the advantages of these devices are low cost, low sample requirement, fast response time, parallel processing and repeatability. One key component of all micro fluidic devices is a means to transport the liquids. This is typically performed with a micro fluidic pump.

Because of the high demand, many types of micro fluidic pumps have been developed including diaphragm pumps, electro hydrodynamic pumps, and electro osmotic pumps. However, most of these pumps suffer from some drawback, such as requiring a high voltage, working only within a certain pH value, requiring a non-sieve that results in filtration of the liquid, large size, and compatibility issues with the underlying micro fluidic device. External pneumatic pumps are commonly used in conjunction with valves, either integrated micro valves, or a plurality of external valves due to the difficulties of fabricating high quality micro valves. There is a need for a micro fluidics device that overcomes these challenges. There is also a need for a micro fluidics device that is configured so that it may be readily integrated with a micro fluidic channel, uses a low voltage, can pump any liquid through pneumatic actuation, and doesn't require any moving parts.

In the last few years, the Knudsen pump has been demonstrated at the micro level for pumping gases. Thermo molecular pumps, such as the Knudsen pump, inherently have a high reliability because they have no moving parts. The Knudsen pump also features a simplified fabrication process (no moving parts), continuous flow, and low operating voltages. The Knudsen pump operates on the principle of thermal transpiration. In 1910, Knudsen demonstrated the possibility of using thermal transpiration for the purpose of gas pumping. The phenomenon of thermal transpiration induces a pressure difference in a narrow channel, whose dimension allows the gas flow in free molecular or transition regimes to become rarefied, when a thermal gradient is established along the channel. A parameter called Knudsen number (Kn) is defined as the ratio of the mean free path of the gas molecules to the hydraulic diameter of the channel and its range for the above mentioned gas flow regimes is $0.1<Kn<10$ and $Kn>10$ respectively. Optimally, the Knudsen number should be greater than 1 for the Knudsen pump to operate efficiently. For operation of a Knudsen pump at atmospheric pressure, channels that have a hydraulic diameter of less than 100 nanometers should be used. When larger channels are used, the pump is operated at pressures lower than atmospheric pressure. Generally if two containers are filled with the same gas separated by a narrow channel and kept at different temperatures, they settle at different pressures.

As Knudsen illustrated, when two large volumes are interconnected by a channel of very small cross-section, of radius smaller than the mean free path length of the gas molecules present, and when the ends of the channel are at different temperatures, then a pressure difference is established between the two large volumes. In the small-sized channel, molecules move under molecular conditions, and as a result the pressures differ at the two ends of the channel because of the temperature difference. Under molecular conditions, when thermal equilibrium is reached, then the pressures at the two ends of the channel are such that the ratio is equal to the square root of the ratio of the corresponding temperatures.

When the molecules reach the large volume adjacent to the hot end of the channel, their travel no longer occurs under molecular conditions, but occurs under viscous medium conditions. As a result, at the hot end of the channel, the molecules escape from the channel and penetrate into the adjacent large volume. This produces a pumping effect with a compression ratio that can be as great as the square root of the temperature ratio.

The flux of gas molecules going through the channel is represent by pressure as 'P', mass of the gas molecules as 'M', Boltzmann's constant absolute temperature as 'T' and subscripts 'h' and 'c' denote hot and cold chamber terms respectively. Once the equilibrium is reached, the ratio of the pressures of the hot and cold chambers is equal to the ratio of the square root of their absolute temperatures. This is represented by the following formula:

$$\frac{P_h}{P_c} = \sqrt{\frac{T_h}{T_c}}$$

In the free molecular flow regime the intermolecular collisions are negligible compared to the interaction of molecules with the walls of the channel. The average speed of molecules arriving from the hotter region is larger than those from the colder region. The mass fluxes from the two regions balance at equilibrium. With an increase of pressure in the chamber of higher temperature, an inverse flow is driven by the pressure difference of the two reservoirs. The two flows are counterbalanced at some pressure difference.

The mass flow rate through a single channel was derived by Sharipov, and is:

where r is the hydraulic radius, L is the length of the channel subjected to a temperature difference of ΔT, ΔP is the pressure difference across the channel, and $T_{av}$ and $P_{av}$ are the average temperature and pressure within the channel. The two flow coefficients, the thermally driven flow coefficient, $M_t$, and the pressure driven flow coefficient, $M_p$, are functions of the Knudsen number.

$$\dot{M} = P_{av}\sqrt{\frac{m}{2kT_{av}}}\,\frac{\pi r^3}{L}\left(\frac{\Delta T}{T_{av}}M_t - \frac{\Delta P}{P_{av}}M_p\right)$$

The maximum flow rate at ΔP=0 is a function of the channel length and the temperatures at the ends of the channel. To obtain the maximum flow rate there has to be an optimization between the channel length and the temperature difference obtained along the channel length, as they are interdependent. A longer channel will provide a larger temperature difference, but reduce the flow rate; while with a shorter channel the temperature difference will be reduced, which in turn will drop the flow rate.

In a micro fluidics environment, in applications that require increased pressure drop multiple micro fluidics pumps in series have been used to increase either the temperature gradient or channel length (e.g. U.S. Pat. No. 7,572,110). However, previously demonstrated pumps were only configured for and could only pump gases. There is a need for a micro fluidic pump that can pump liquid from a reservoir inside capillaries using thermal transpiration.

One of the major challenges encountered by the previous Knudsen pump designs is to thermally isolate the hot and cold chambers from each other. The hot chamber is actively heated while the cold chamber temperature is passively cooled. To maintain the cold chamber at room temperature a relatively long channel is used, but this adversely impacts the pump's flow rate. Furthermore, to optimize the pump efficiency, it is desired to thermally insulate the hot chamber to minimize thermal losses, and simultaneously cool the cold chamber. Previous pumps have passively cooled the cold chamber by using large areas to minimize the thermal resistance and by using heat sinks. The need for very different geometries for the hot and cold sides makes it difficult to make an efficient Knudsen pump that is also bi-directional. There is a need for a Knudsen pump, particularly a micro pump, with an actively cooled cold chamber which eliminates the need for a heat sink. Additionally, both hot and cold chambers can be thermally insulated thereby improving efficiency. It is then possible to create an efficient bi-directional Knudsen pump. A further advantage is that the channel length can be minimized, reducing the channel flow conductance and increasing the gas flow rate.

Thermoelectric materials exhibit the Peltier effect. When a voltage is applied across the two ends of the thermoelectric material or in other words current flows through the thermoelectric material a temperature difference is obtained across the same. The charge carriers (electrons) start moving in the opposite direction of the current, transferring the heat with them from one side of the material to the other side and in the process creating a temperature gradient across the material. For example, a thermoelectric or Peltier module is a solid state active heat transfer device which transfers heat from one side of the device to the other when voltage is applied across the device. The direction of heat transfer is controlled by the polarity of the current; therefore, reversing polarity will change the direction of heat transfer. A thermoelectric heat transfer module or device is comprised of one or more thermoelectric materials.

There is a need for a thermally driven micropump such as the Knudsen pump of the present invention. The pump of the present invention has no moving parts, high reliability and uses a low operating voltage. Additionally, the absence of moving parts allows a simple fabrication process. Once the operation has reached equilibrium, the Knudsen pump generates a continuous flow.

It is an objective of the present invention to create a pump with improved flow rates and efficiency as compared to prior art Knudsen pumps. It is another objective of the present invention to create an embodiment of the pump that is a thermoelectric Knudsen pump which utilizes a thermoelectric material to both actively heat the hot chamber and actively cool the cold chamber. It is another objective of the present invention to create an embodiment that is a bi-directional pump whereby the pump direction can be switched by changing the voltage polarity across the thermoelectric material. Another objective of the present invention is to create an embodiment that is a symmetrical pump with no moving parts. Yet another objective of the present invention is to create an embodiment that is a uni-directional pump integrated in a lab-on-chip device with no moving parts that operates using thermal transpiration.

BRIEF SUMMARY OF THE INVENTION

One embodiment of the thermally driven pump of the present invention utilizes a thermoelectric material to assist with the thermal transpiration process resulting in a substantially symmetrical, bidirectional pump. A major challenge in the design of thermal transpiration based pumps is to ensure good thermal isolation between the hot and cold ends of the pump to maximize the thermal difference. The primary parameters affecting the thermal isolation are the thermal conductivity of the pump channel material and the length of the channel separating the hot and cold sides. Although a longer channel will improve the thermal isolation, a longer channel increases the gas flow impedance, requiring a tradeoff to be made.

Prior art Knudsen pumps typically use a resistive heater to actively heat the hot side and the cold side is passively cooled by means of a heat sink. The total power consumption is minimized by thermally insulating the hot side. This creates an asymmetric design in which the hot and cold sides have different geometries and different material requirements.

In the first embodiment of the present invention, a thermoelectric module is used to actively heat the hot side while simultaneously actively cooling the cold side. Without the need for a heat sink, the design of this embodiment of the present invention is substantially symmetrical, and the pump can be operated in the forward or reverse directions by changing the direction of current flow in the thermoelectric module.

The bidirectional thermoelectric pump of the present invention comprises a thermal transpiration channel of suitable diameter for thermal transpiration. Said channel having a cold end and a hot end, said cold end connected to a first fluid reservoir and a hot end connected to a second fluid reservoir. In one embodiment, the thermal transpiration channel is comprised of a nanoporous article having at least one nanochannel of suitable diameter for thermal transpiration. Said nanochannel traversing said nanoporous article from said cold end to said hot end. A first heat transfer plate is positioned adjacent to the hot end of the channel. Likewise, a second heat transfer plate is positioned adjacent to the cold end of the channel.

The thermoelectric pump of the present invention further comprises a thermoelectric heat transfer device intermediate to the first and second heat transfer plates such that the hot side of the device is adjacent to said first plate and the cold side of the device is adjacent to the second plate. The thermoelectric heat transfer device comprised of a thermoelectric material having a first electrical connector electrically connected to a hot side of said thermoelectric device, a second electrical connector electrically connected to a cold side of said thermoelectric device and a power supply electrically connected to said first and second connectors. Said first connector and said second connecter electrically connected such that a circuit, when closed, traverses said thermoelectric device from said hot side to said cold side. When the first connector is connected to the negative terminal of the power supply and the second connector is connected to the positive terminal of the power supply, the circuit is closed and a voltage is applied, current flows through the thermoelectric material from said hot side to said cold side. Charge carriers (electrons) start moving in the opposite direction of the current (from said cold side to said hot side), thereby cooling the cold side by transferring heat from said cold side of the material to said hot side and creating a temperature gradient across the thermoelectric device.

The hot side of the thermoelectric heat transfer device is thermally connected to said hot end of said thermal transpiration channel by the first heat transfer plate such that the hot side of the thermoelectric device actively heats the hot end of the channel. The cold side of the thermoelectric device is connected to said cold end of the channel by the second heat transfer plate such that the cold side of the thermoelectric heat transfer device actively cools the cold end of the channel. Thus a temperature gradient is established across the channel inducing fluid flow through the channel from the first reservoir to the second reservoir via thermal transpiration and thereby creating a pressure differential. When the polarity of the power supply is reversed, the current flows the opposite direction, heat transfer occurs in the opposite direction and fluid flows from the second reservoir to the first reservoir.

The efficiency of a Knudsen pump is dependent on the ratio of the absolute temperatures. The greater the temperature gradient across the channel, the more efficient the pump. As compared to other Knudsen pumps, the thermoelectric pump of the present invention maintains a lower temperature on the cold end of the thermal transpiration channel and a higher temperature on the hot end of the channel thereby producing a greater temperature gradient resulting in increased efficiency. This active cooling of the cold end results in lower temperatures and a larger temperature gradient than those exhibited by prior art Knudsen pumps. Additionally, the design of the pump of the present invention eliminates the need for a heat sink and makes the pump geometry symmetrical, as compared to existing designs which are asymmetrical. Due to the symmetrical design of the pump of the present invention, the hot and cold ends of the pump can be interchanged by changing the polarity of the power supply thus creating a bi-directional pump.

A second embodiment of the thermally driven pump of the present invention comprises a uni-directional, pneumatic, micro fluidic, Knudsen pump which can be integrated into a lab-on-chip device. The micro fluidic pump is configured to pump liquids. The pump is integrated into the substrate of the lab-on-chip device during fabrication of the substrate while creating other channels and lab-on-chip components. The simultaneous fabrication of the Knudsen pump during fabrication of other lab-on-chip channels and components facilitates an integrated configuration between the Knudsen pump and the channels through which the pump is connected and may push liquids through during operation of the lab-on-chip device.

The Knudsen pump of the second embodiment is generally comprised of a channel system comprised of a nanochannel and a shallow channel in series with other channels within the lab-on-chip substrate, both of which are covered by a slab or slide comprised of material conducive to finalize creation of the Knudsen channels. The substrate of the lab-on-chip device is manipulated to include a heater such as a resistive element in proximity to a terminal end of the shallow channel opposite the end of the shallow channel that is adjacent and in series with the other channels within the lab-on-chip substrate. The heater heats the terminal end of the nanochannel, for instance by running current through a resistive element. Upon heating the terminal end of the nanochannel, a temperature gradient is created along the nanochannel in series with the nanochannel causing pressure to be formed within the channels and gas to flow out of the nanochannel through the terminal end of the nanochannel thereby creating suction that pulls liquid through the other channels within the lab-on-chip substrate. Alternatively, the heater is placed at the opposite end of the nanochannel adjacent the shallow channel. When the heater is heating, air is drawn into the nanochannel through the terminal end and into the shallow channel. If there is liquid in the shallow channel, the air pushes the liquid out of the shallow channel and through the series of attached channels on the chip.

DETAILED DESCRIPTION OF THE INVENTION

Various embodiments are described more fully below with reference to the accompanying drawings, which form a part hereof, and which show specific embodiments of the invention. However, embodiments may be implemented in many different forms and should not be construed as limited to the embodiments set forth herein; rather, these embodiments are provided so that this disclosure will be thorough and complete, and will fully convey the scope of the invention to those skilled in the art. Accordingly, the following detailed description is, therefore, not to be taken in a limiting sense.

Figure 1A:
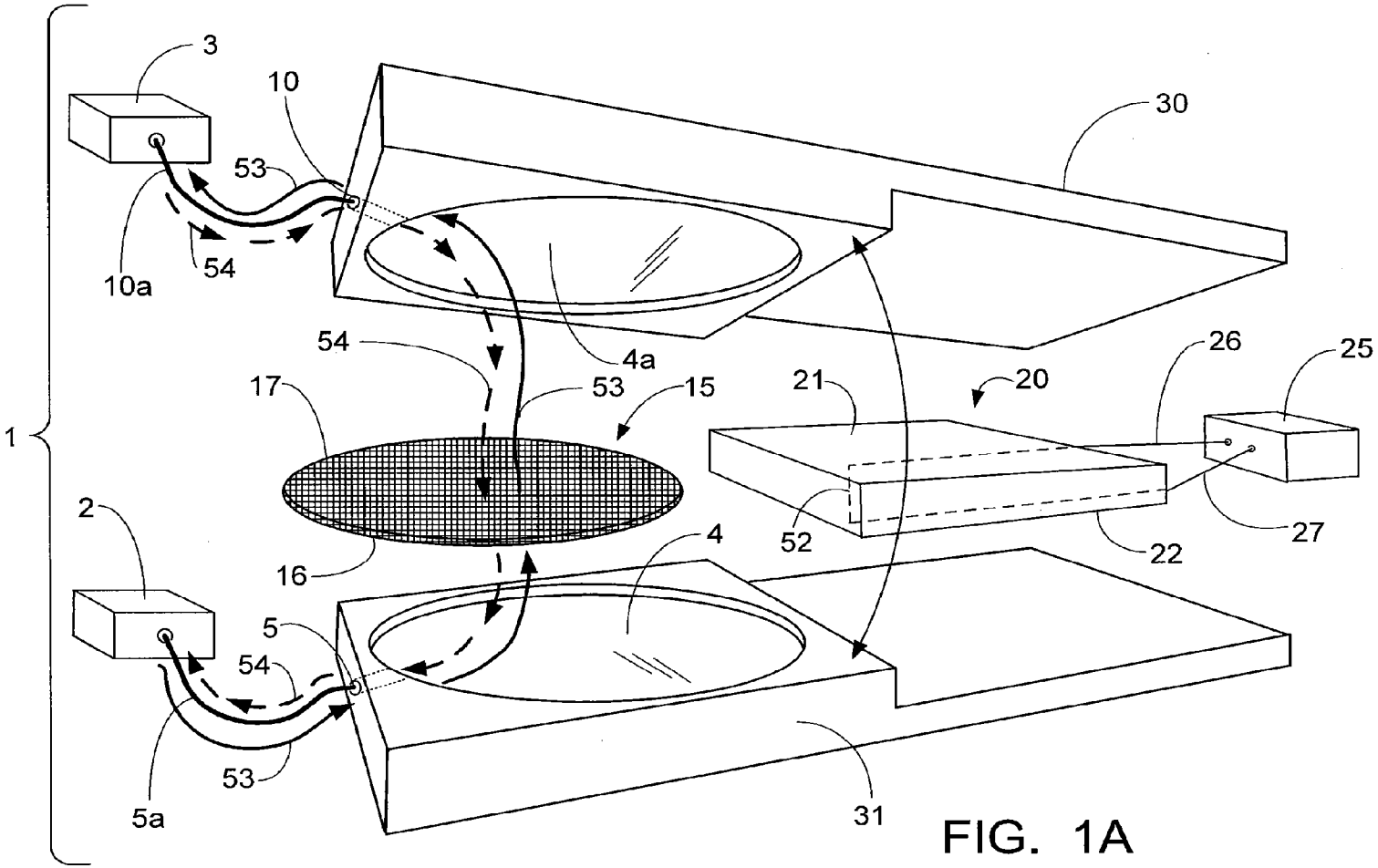
FIG. 1*a* is an exploded side view of a lateral design of the thermoelectric Knudsen pump.
Figure 1B:
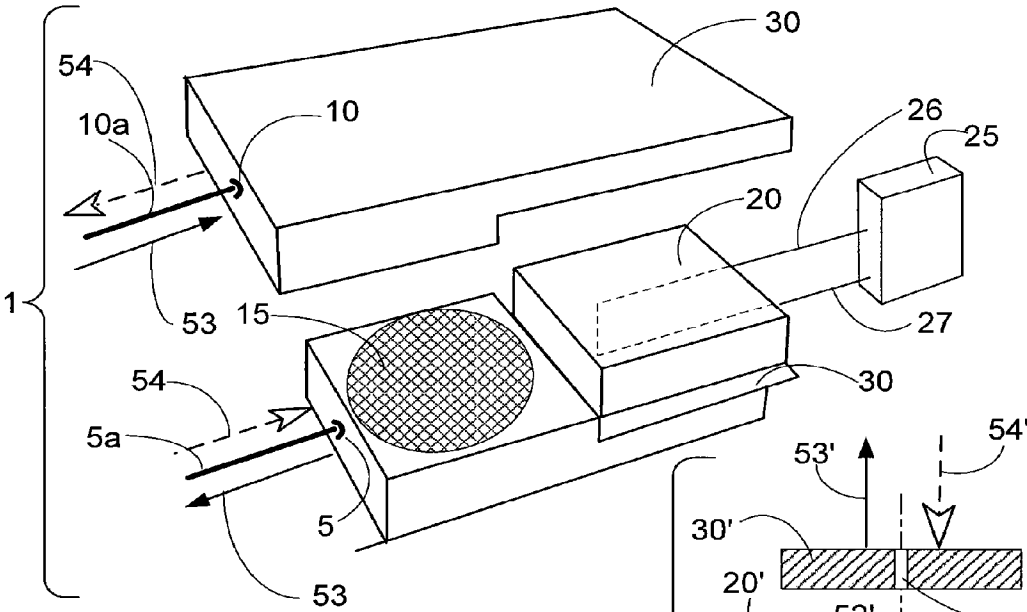
FIG. 1*b* is a top view of a lateral design of the thermoelectric Knudsen pump.

A first embodiment of the thermally driven pump of the present invention utilizes a thermoelectric material to assist with the thermal transpiration process resulting in a substantially symmetrical, bidirectional pump. Referring now to FIGS. 1*a* and 1*b*, the thermoelectric, bidirectional pump 1 comprises a nanoporous article 15 having at least one nanochannel (not shown) of suitable diameter for thermal transpiration. A port 5 capable of receiving a conduit 5*a* such as a pipe, tube, channel or the like is adjacent to a first end 16 of said nanoporous article. The second end of said conduit (5*a*) may be connected to the port 5 and to a first fluid reservoir 2. A port 10 capable of receiving a conduit 10*a* such as a pipe, tube, channel or the like is adjacent to a second end 17 of said nanoporous article. The conduit 10*a* is capable of being connected to a second fluid reservoir 3. Each of said nanochannels traversing said nanoporous article 15 from said first end 16 to said second end 17. There is an air gap 4*a* adjacent to said second end 17 and air gap 4 adjacent to said first end 16 for distributing the fluid over said first end 16 and second end 17 of the nanoporous article 15. When the pump is pumping, fluid enters the pump 1 through the port 5, is distributed through the air gap 4 across the first end 16 of the nanoporous article 15, through the nanochannels, collects in the air gap 4*a* across the second end 17 and exits through the port 10. The air gaps 4, 4*a* help maintain the temperature difference across the nanoporous article 15 by reducing the rate of heat flow through the nanoporous article 15.

Figure 3A:
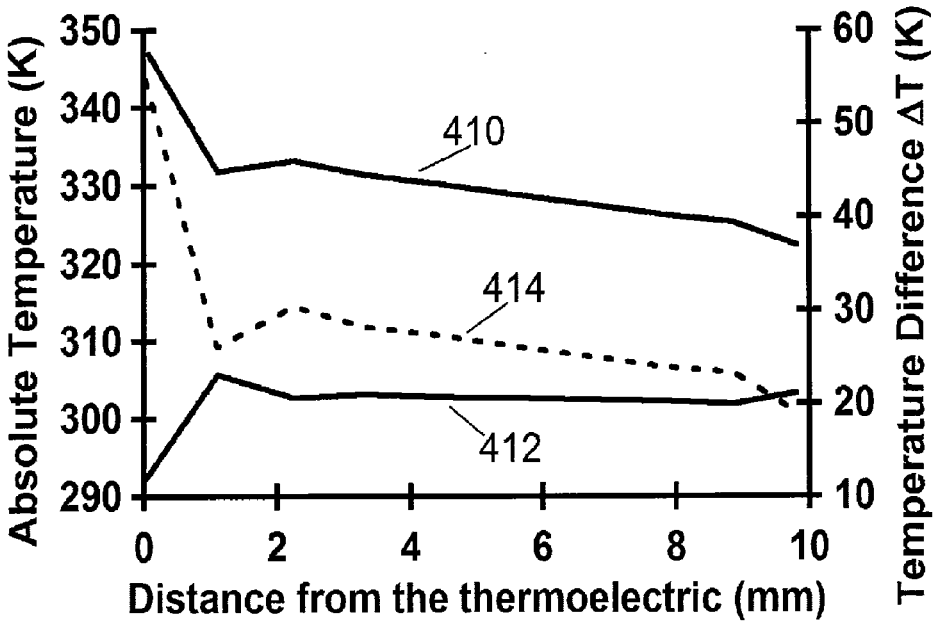
FIGS. 3*a* and 3*b* are illustrations showing a comparison of temperature distribution across the first side and second side of the nanoporous article for a lateral design example of the thermoelectric Knudsen pump where the nanoporous article is 1 mm thick (3*a*) and 105 micrometers thick (3*b*).
Figure 3B:
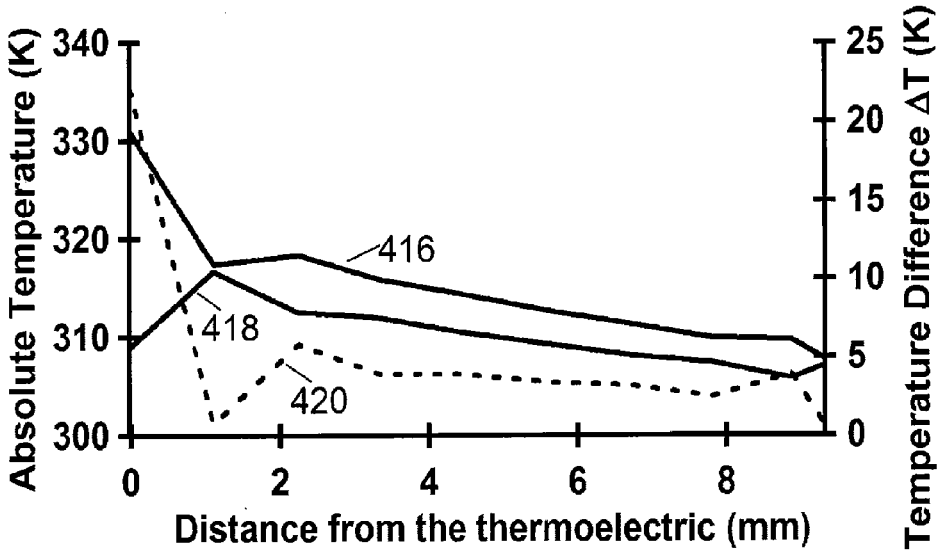

The nanoporous article 15 may be made of any porous material with nanochannels sufficiently sized in both diameter and channel length to promote thermal transpiration. The parameter called Knudsen number (Kn) is defined as the ratio of the mean free path of the gas molecules to the hydraulic diameter of the channel and its range for the above mentioned gas flow regimes is $0.1<Kn<10$ and $Kn>10$ respectively. Optimally, the Knudsen number should be greater than 1 for the pump to operate efficiently. For operation at atmospheric pressure, channels that have a hydraulic diameter of less than 100 nanometers should be used. The nanoporous article 15 is preferably a material which is low in thermal conductivity such a polymer, glass, or ceramic. For example, a nanoporous article of cellulose esters (such as filter disks manufactured by Millipore Corporation, part #WMWP04700) with 50 nanometer pore size and of 1 mm thickness are used. The thicker the nanoporous material, the larger the temperature difference maintained across the nanoporous material. For example, a 1 mm thick nanoporous article produced a substantially greater thermal difference in a simulation than a 105 micrometer thick nanoporous article as shown in FIGS. 3*a* and 3*b*. On average, the 1 mm thick nanoporous article generates a temperature difference 6 times better than the 105 micrometer thick nanoporous article.

Referring back to FIGS. 1*a* and 1*b*, the nanoporous article 15 is intermediate to two heat transfer plates (30, 31) which serve as heat spreaders and control the hot and cold temperatures of the ends of the nanochannels. A first heat transfer plate 30 is aligned with said second side 17 of said nanoporous article 15. A second heat transfer plate 31 is aligned with said first side 16 of said nanoporous article 15. The heat transfer plates 30, 31 may be made of any conductive material such as copper, aluminum or graphite. Spacers 51 (see FIGS. 2*a*, 2*b*), such as o-rings, may be used in some embodiments to create the air gaps 4, 4*a* between the first and second ends 16, 17 and the heat transfer plates 30, 31.

Still referring to FIGS. 1*a* and 1*b*, a thermoelectric heat transfer device 20 is intermediate to said heat transfer plates 30, 31. The thermoelectric heat transfer device 20 is comprised of a thermoelectric material and has a first electrical connector 26 electrically connected to a top 21 of said thermoelectric device 20, a second electrical connector 27 electrically connected to a bottom 22 of said thermoelectric device 20 and a power supply 25 electrically connected to said first 26 and second 27 connectors. Said first connector 26 and said second connecter 27 electrically connected such that a circuit 52, when closed, traverses said thermoelectric device 20 from said top 21 to said bottom 22. The first heat transfer plate 30 is aligned with said top 21 of said thermoelectric device 20. The second heat transfer plate 31 is aligned with the bottom 22 of said thermoelectric device 20. The heat transfer plates 30, 31 act as heat spreaders and transfer the heat from both sides (21, 22) of the thermoelectric device 20 to the nanoporous article 15 thereby actively heating the hot side while simultaneously actively cooling the cool side of the thermal pump 1.

Any thermoelectric heat transfer device 20 which meets the size and operating parameters required for the particular application may be used. For example, a thermoelectric module (part #03111-9J30-20CA) manufactured by Custom Thermoelectric, USA or (part #CH-38-1.0-0.8) manufactured by TE Technologies, USA may be used. The thermoelectric device comprises at least one thermoelectric material capable of inducing a temperature gradient across the device when current is applied.

In one embodiment, insulation (not shown) is attached to the first and second heat transfer plates 30, 31 of the thermoelectric pump, thereby enclosing the heat transfer plates 30, 31, the nanoporous article 15, and the thermoelectric device 20. In another embodiment, thermal grease (not shown) is applied between the heat transfer plates 30, 31 and the thermoelectric device 20 to maximize transfer to the heat transfer plates 30, 31.

To induce flow from the first reservoir 2 to the second reservoir 3, the first connector 26 of the thermoelectric device 20 is connected to the negative terminal of the power supply 25 and the second connector 27 of the thermoelectric device 20 is connected to the positive terminal of the power supply 25. When the circuit is closed and a voltage is applied, current flows through the thermoelectric device 20 from said top 21 to said bottom 22. Charge carriers (electrons) start moving in the opposite direction of the current (from said bottom 22 to said top 21), thereby transferring heat from said bottom 22 of the material to said top 21 and creating a temperature gradient across the thermoelectric device 20.

The first heat transfer plate 30 actively heats the second end 17 of the nanoporous article 15. The first side 21 is adjacent to the first heat transfer plate 30; therefore, when the top 21 heats up, some of that heat is transferred to the first heat transfer plate 30 through conduction and the first heat transfer plate 30 also heats up. This causes the second end 17 of the nanoporous article 15 to heat up through conduction. Similarly, the second heat transfer plate 31 actively cools the first end 16 of the nanoporous article 15. The first end 16 of the nanoporous article 15 and the bottom 22 of the thermoelectric device are adjacent to the second heat transfer plate 31. Heat is transferred away from the first end 16 towards the bottom 22 thereby actively cooling the first end 16 of the nanoporous article 15.

This process establishes a temperature gradient across the thermoelectric device from the bottom 22 to the top 21. Likewise, a temperature gradient and corresponding pressure differential is established across the nanoporous article 15 from the first end 16 to the second end 17 inducing fluid flow through the nanoporous article 15 from the port 5 to the port 10 via thermal transpiration (forward flow 53). Because there is no need for a heat sink to cool one side of the nanoporous article 15, the design is substantially symmetrical.

Flow is induced in the reverse direction from the second reservoir 3 to the first reservoir 2 by reversing the polarity of the power supply 25. The first connector 26 of the thermoelectric device 20 is connected to the positive terminal of the power supply 25 and the second connector 27 of the thermoelectric device 20 is connected to the negative terminal of the power supply 25. When the circuit 52 is closed and a voltage is applied, current flows through the thermoelectric device 20 from said bottom 22 to said top 21. Charge carriers (electrons) start moving in the opposite direction of the current (from said top 21 to said bottom 22), thereby transferring heat from said top 21 to said bottom 22 and creating a temperature gradient across the thermoelectric device 20.

The second heat transfer plate 31 actively heats the first end 16 of the nanoporous article 15. The bottom 22 is adjacent to the second heat transfer plate 31; therefore, when the bottom 22 heats up, some of that heat is transferred to the second heat transfer plate 31 through conduction and the second heat transfer plate 31 also heats up. This causes the first end 16 of the nanoporous article 15 to heat up through conduction. Similarly, the first heat transfer plate 30 actively cools the second end 17 of the nanoporous article 15. The second end 17 of the nanoporous article 15 and the top 21 of the thermoelectric device are adjacent to the first heat transfer plate 30. Heat is transferred away from the second end 17 towards the top 21 thereby cooling the second end 17 of the nanoporous article 15.

This process establishes a temperature gradient across the thermoelectric device from the top 21 to the bottom 22. Likewise, a temperature gradient and corresponding pressure differential is established across the nanoporous article 15 from the second end 17 to the first end 16 inducing fluid flow through the nanoporous article 15 from the port 10 to the port 5 via thermal transpiration (reverse flow 54).

Those of skill in the art recognize that there are many design configurations for the bidirectional thermoelectric pump of the present invention. FIGS. 1*a* and 1*b* show one example of a design of the bidirectional pump 1, the lateral pump design. In the lateral pump design, one side of the thermoelectric device 20 is adjacent to one side of the nanoporous article 15. The nanochannels are long in this design and provide better thermal isolation between the hot and cold sides of the pump 1.

Figure 2B:
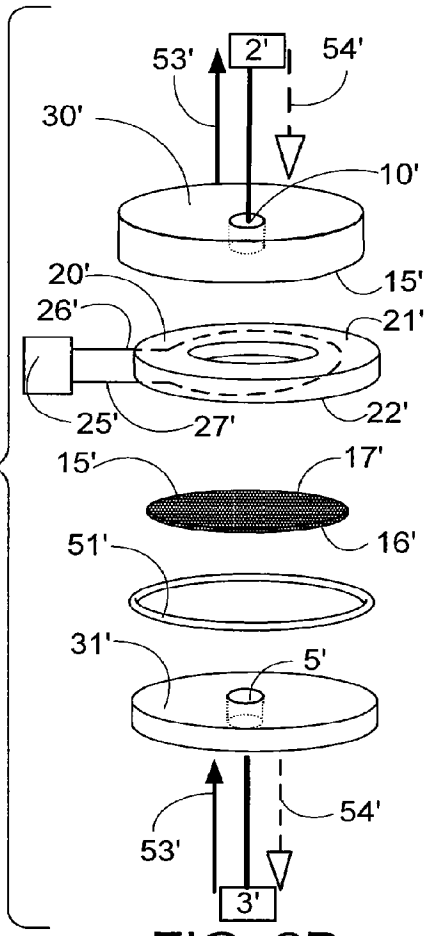
FIG. 2*b* is a cross sectional side view of a radial design of the thermoelectric Knudsen pump.
Figure 2A:
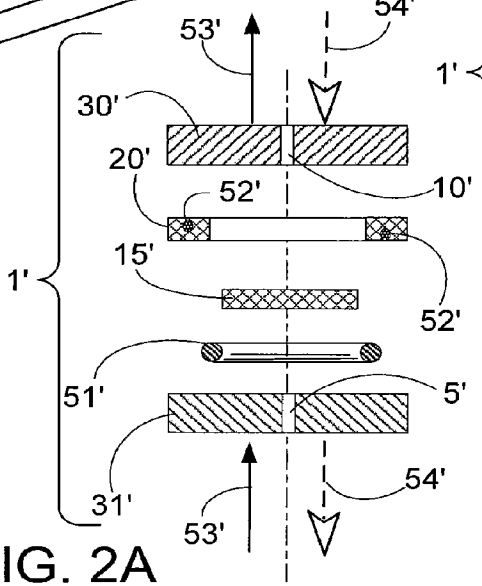
FIG. 2*a* is an exploded side view of a radial design of the thermoelectric Knudsen pump.

FIGS. 2*a* and 2*b* show another example of a design of the bidirectional pump 1', the radial pump design. In this design, the thermoelectric device 20' is in an annular shape and encircles the nanoporous article 15'. Utilization of an annular shaped thermoelectric device 20' results in better and more uniform heat transfer to the heat transfer plates 30', 31' and through the nanoporous article 15'. The port 5' intersects the second heat transfer plate 31' and terminates in air gap 4 between the second end of the nanoporous article 17' and the plate 31'. The port 10' intersects the first heat transfer plate 30' and terminates in air gap 4*a'* between the first end of the nanoporous article 16' and the first plate 30'. A spacer 51 such as an o-ring is intermediate to the heat transfer plates 30', 31' and the nanoporous article 15' in some embodiments. The temperature differential is larger with this design which results in a larger pressure differential and a larger mass flow rate. The short nanochannel length of this design minimizes gas flow impedance and improves the gas flow rate over designs with longer channels. Also, the nanoporous article 15 does not suffer convection and radiation heat losses from the sidewalls to the environment since the thermoelectric device surrounds the sidewalls.

To induce flow from the first reservoir 2' to the second reservoir 3', the first connector 26' of the thermoelectric device 20' is connected to the negative terminal of the power supply 25' and the second connector 27' of the thermoelectric device 20' is connected to the positive terminal of the power supply 25'. When the circuit is closed and a voltage is applied, current flows through the thermoelectric device 20' from said top 21' to said bottom 22'. Charge carriers (electrons) start moving in the opposite direction of the current (from said bottom 22' to said top 21'), thereby transferring heat from said bottom 22' of the material to said top 21' and creating a temperature gradient across the thermoelectric device 20.

The first heat transfer plate 30' actively heats the second end 17' of the nanoporous article 15'. The first side 21' is adjacent to the first heat transfer plate 30'; therefore, when the top 21' heats up, some of that heat is transferred to the first heat transfer plate 30' through conduction and the first heat transfer plate 30' also heats up. This causes the second end 17' of the nanoporous article 15' to heat up through conduction. Similarly, the second heat transfer plate 31' actively cools the first end 16' of the nanoporous article 15'. The first end 16' of the nanoporous article 15' and the bottom 22' of the thermoelectric device 20' are adjacent to the second heat transfer plate 31'. Heat is transferred away from the first end 16' towards the bottom 22' thereby actively cooling the first end 16 of the nanoporous article 15'.

This process establishes a temperature gradient across the thermoelectric device 20' from the bottom 22' to the top 21'. Likewise, a temperature gradient and corresponding pressure differential is established across the nanoporous article 15' from the first end 16' to the second end 17' inducing fluid flow through the nanoporous article 15' from the port 5' to the port 10' via thermal transpiration (forward flow 53'). Because there is no need for a heat sink to cool one side of the nanoporous article 15', the design is substantially symmetrical.

Flow is induced in the reverse direction from the second reservoir 3' to the first reservoir 2' by reversing the polarity of the power supply 25'. The first connector 26' of the thermoelectric device 20' is connected to the positive terminal of the power supply 25' and the second connector 27' of the thermoelectric device 20' is connected to the negative terminal of the power supply 25'. When the circuit 52' is closed and a voltage is applied, current flows through the thermoelectric device 20' from said bottom 22' to said top 21'. Charge carriers (electrons) start moving in the opposite direction of the current (from said top 21' to said bottom 22'), thereby transferring heat from said top 21' to said bottom 22' and creating a temperature gradient across the thermoelectric device 20'.

The second heat transfer plate 31' actively heats the first end 16' of the nanoporous article 15'. The bottom 22' is adjacent to the second heat transfer plate 31'; therefore, when the bottom 22' heats up, some of that heat is transferred to the second heat transfer plate 31' through conduction and the second heat transfer plate 31' also heats up. This causes the first end 16' of the nanoporous article 15' to heat up through conduction. Similarly, the first heat transfer plate 30' actively cools the second end 17' of the nanoporous article 15'. The second end 17' of the nanoporous article 15' and the top 21' of the thermoelectric device are adjacent to the first heat transfer plate 30'. Heat is transferred away from the second end 17' towards the top 21' thereby cooling the second end 17' of the nanoporous article 15'.

This process establishes a temperature gradient across the thermoelectric device from the top 21' to the bottom 22'. Likewise, a temperature gradient and corresponding pressure differential is established across the nanoporous article 15' from the second end 17' to the first end 16' inducing fluid flow through the nanoporous article 15' from the port 10' to the port 5' via thermal transpiration (reverse flow 54').

There are many applications for the thermoelectric pump 1 of the first embodiment of the present invention as will be recognized by those of skill in the art. For example, the thermoelectric pump 1 is included on a microchip to pump fluid from a first reservoir 2 to a second reservoir 3 within the microchip. Another application for the thermoelectric micro pump 1 is to transfer a gas sample to a gas spectrometer for testing. Additionally, another application of the thermoelectric micro pump is in a lab-on-chip environment either alone or in series with multiple pumps for moving fluids to different locations for different processes on the chip.

Examples of the First Embodiment

Other features of the first embodiment of the present invention will become apparent in the course of the following examples which are given for illustration of the invention and are not intended to be limiting thereof.

One example of the lateral pump design comprises a nanoporous article made of a nanoporous polymer material having nanochannels for the thermoelectric Knudsen pump. This design provides a high flow rate due to parallel nanochannels acting in unison. Fifty nanometer (50 nm) pore sized filter disc composed of mixed cellulose esters from Millipore Corporation, USA, was used for thermal transpiration channels. For a 50 nm pore size channel over a temperature rage of between approximately 280° K to 380° K, the Kn is between about 1.07 and 1.45. The membrane is 105 micrometers (μm) thick making it necessary to stack the discs to maintain a significant thermal gradient which facilitated the physics of thermal transpiration. A thickness of 1 millimeter was used. A channel length of 1 mm was found to maintain a temperature gradient of 30° C. across the polymer stack. The maximum operating temperature of this material is reported to be between 55° C. and 70° C. The maximum operating temperature limits the maximum achievable pressure and flow rate of the pump. A thermoelectric device from Custom Thermoelectric, USA was used. The thermoelectric module and the polymer stack were placed adjacent to each other and then coupled with thick (3/16") copper plates. Copper plates having a thickness of 5 mm each were used for the heat transfer plates and are sufficient to maintain the temperature gradient across the polymer stack. The following experimental data were generated with the described lateral pump design.

Simulations of the devices were performed using CoventorWare to model the temperature distribution of the devices. Thermal conduction was used to simulate the thermal transport in the solid materials. Thermal transport due to free convection of air at a pressure of $10^5$ Pa was simulated using a built-in computational fluid dynamics (CFD) module. The heat flow due to the gas pumping was neglected in the simulations because the gas flowing through the nanoporous article is in the transition flow regime, which is difficult to properly simulate. The boundary conditions for the simulations use a temperature of 285° K on the cold side of the thermoelectric, 355° K on the hot side of the thermoelectric, and 298° K on the outer-most air boundary. The fixed temperature boundaries alleviate the need for accurate modeling of the thermoelectric. The thermal conductivities of the materials used in the simulation are listed in Table 1.

TABLE 1

Values of thermal conductivities used in the simulations.

| Material | Thermal Conductivity (W/m · K) |
|---|---|
| Aluminum | 273 |
| Air | 0.02 |
| Thermoelectric | 1.2 |
| Nanoporous material | 0.15 |
| Copper | 398 |
| Polymer cladding in lateral pump simulations | 0.12 |

Referring now to FIGS. 3*a* and 3*b* which show a comparison of the temperature distribution across the first side and the second side of the nanoporous article obtained by simulation. FIG. 3*a* shows the temperature profile of the hot side 410, the temperature profile of the cold side 412, and the difference between the two 414 for a 1 mm thick nanoporous article. FIG. 3*b* shows the temperature profile of the hot side 416, the temperature profile of the cold side 418, and the difference between the two 420 for a 105 micrometer thick nanoporous article. The 1 mm thick nanoporous article shows a substantially greater thermal difference. For the 105 micrometer thick nanoporous article, the temperature difference drops to nearly zero where the nanoporous article is supported and there is no air gap. Regarding the lateral pump as shown in FIG. 3*a*, a large temperature change can be seen for the hot side 410, while the cold side 412 remains nearly uniform in temperature. The air gap between the heat transfer plates and nanoporous article helps maintain the temperature difference by reducing the rate of heat flow through the nanoporous article. Where there is no air gap (at 1 mm and 10 mm), the hot side temperature 410 is reduced and the cold side temperature 412 is increased resulting in a smaller temperature difference.

One example of the radial pump design, a thermoelectric module (TE Technology, USA) is in the shape of an annular ring with a hole in the center that encircles the nanoporous article. The thermoelectric module used has an outer diameter of 24 mm, an inner diameter of 9.8 mm and is 3.1 mm thick. The nanoporous article is mixed cellulose ester obtained from Millipore Corporation, USA. The nanoporous article is 5/16 inches in diameter, 105 micrometers thick, and has a 100 nanometer pore size. For a 100 nm pore size channel over a temperature rage of between approximately 280° K to 380° K, the Kn is between about 0.53 and 0.72. The maximum operating temperature of this polymer material is reported to be between 75° C. and 130° C. The maximum operating temperature limits the maximum achievable pressure drop and flow rate of the pump. Aluminum plates were used on either side of the thermoelectric module to facilitate heat transfer. The following experimental data were generated with the described radial pump design.

Figure 4:
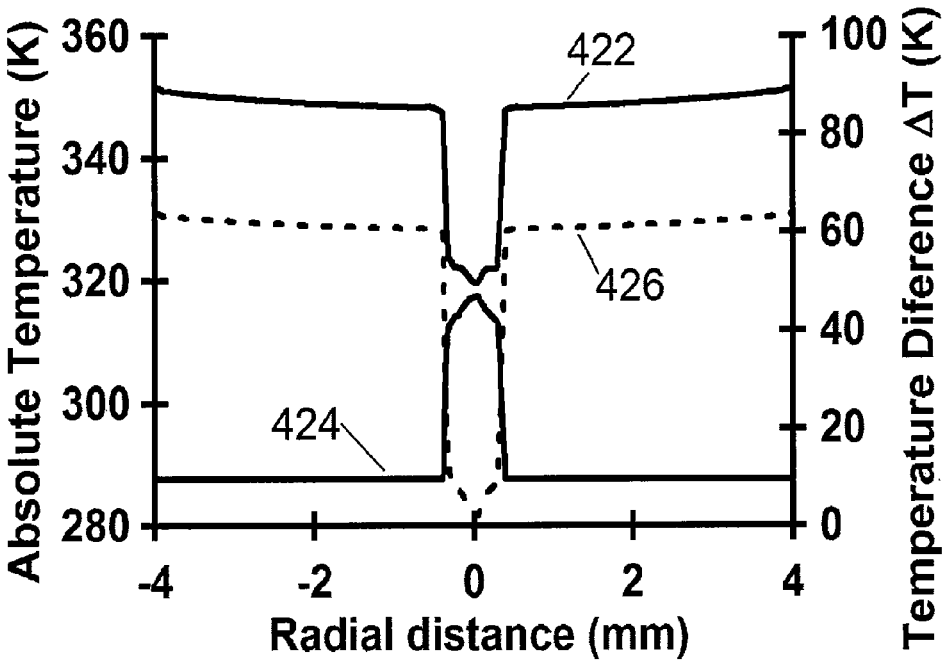
FIG. 4 are illustrations showing the temperature distribution along the first side and second side of the nanoporous article for a radial design example of the thermoelectric Knudsen pump.

Regarding the radial pump FIG. 4 shows the temperature distribution along the first (hot) side 422 and second (cold) side 423 of the nanoporous article. The temperature difference 424 is also shown. The temperature difference is greater than 60 K for the entire nanoporous material, except where the holes are drilled in the heat transfer plates, where the temperature difference drops to zero.

Figure 5A:
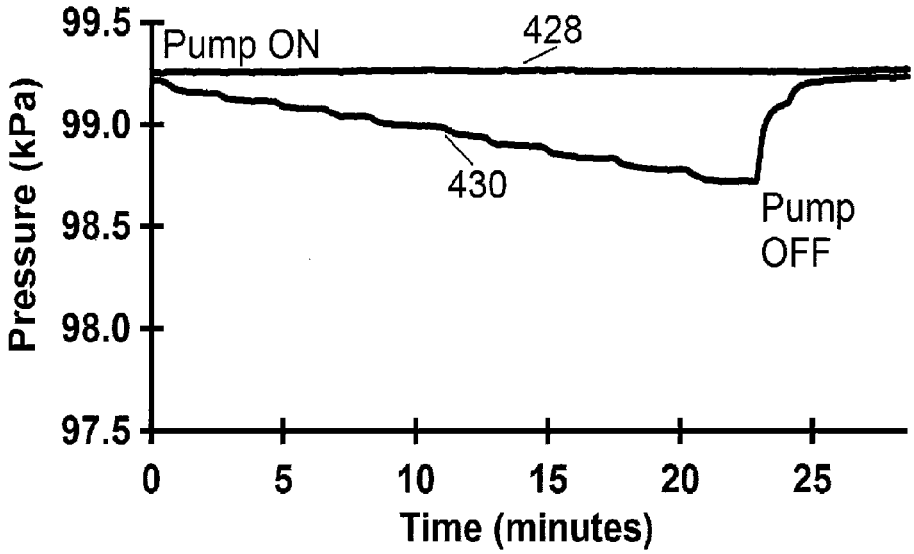
FIGS. 5*a* and 5*b* are illustrations showing the pressure differential at the cold end of the thermoelectric Knudsen pump for the lateral design example (5*a*) and the radial design example (5*b*).
Figure 5B:
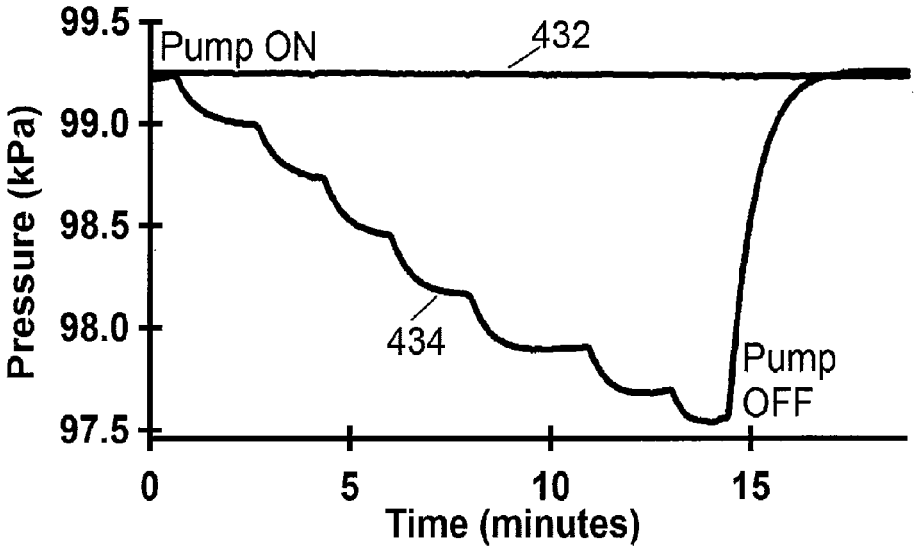

The difference in the pressure at the second (cold) side and ambient pressure provides the pressure difference generated by the pump. FIGS. 5*a* and *b* show the pressure difference as a function of time when subjected to the sequence of input powers provided in Tables 2 and 3. FIG. 5*a* shows the pressure difference obtained with the lateral design example for ambient pressure 428 and at the second (cold) side 430. FIG. 5*b* shows the pressure difference obtained with the radial design example for ambient pressure 432 and at the second (cold) side 434. The power to the pump is incremented in steps and the pressure difference is recorded. The pressure is permitted to stabilize, meaning that the flow rate becomes zero, before incrementing the power level to a new constant value. The maximum pressure difference obtained is 1.686 kPa using the radial pump design example. Tables 2 and 3 provide the input power values corresponding to each pressure step in FIG. 5(*a*) and FIG. 5(*b*), respectively.

TABLE 2

For the lateral pump design example, this table shows the measured pressure difference obtained as a function of the input power. Each line of the table corresponds to a step in the pressure curve 430 shown in FIG. 5(a).

| Power (Watts) | Pressure Difference (Pa) |
|---|---|
| 0.18 | 96.53 |
| 0.04 | 137.9 |
| 0.70 | 172.4 |
| 1.1 | 213.7 |
| 1.5 | 273.0 |
| 2.0 | 315.8 |
| 2.5 | 369.6 |
| 3.1 | 428.2 |
| 3.8 | 482.6 |
| 4.5 | 539.9 |

TABLE 3

For the radial pump design, this table shows the measured pressure difference obtained as a function of the input power. Each line of the table corresponds to a step in the pressure curve 434 shown in FIG. 5(b).

| Power (Watts) | Pressure Difference (Pa) |
|---|---|
| 0.23 | 250.2 |
| 1.9 | 510.2 |
| 1.9 | 786.7 |
| 3.3 | 1076 |
| 4.7 | 1334 |
| 6.6 | 1544 |
| 8.5 | 1686 |

Figure 6A:
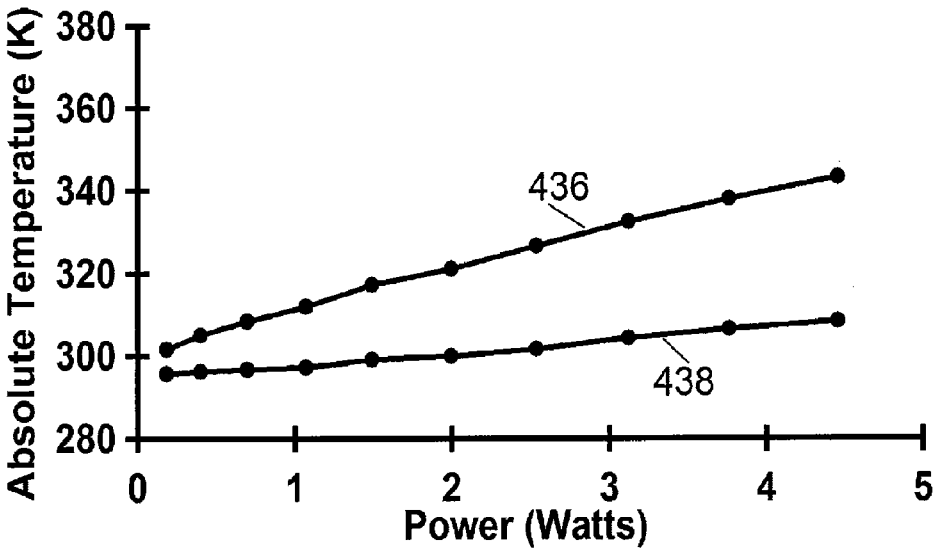
FIGS. 6*a* and 6*b* are illustrations showing the temperatures of the hot and cold sides of the thermoelectric Knudsen pump as a function of input power for the lateral design example (6*a*) and the radial design example (6*b*).
Figure 6B:
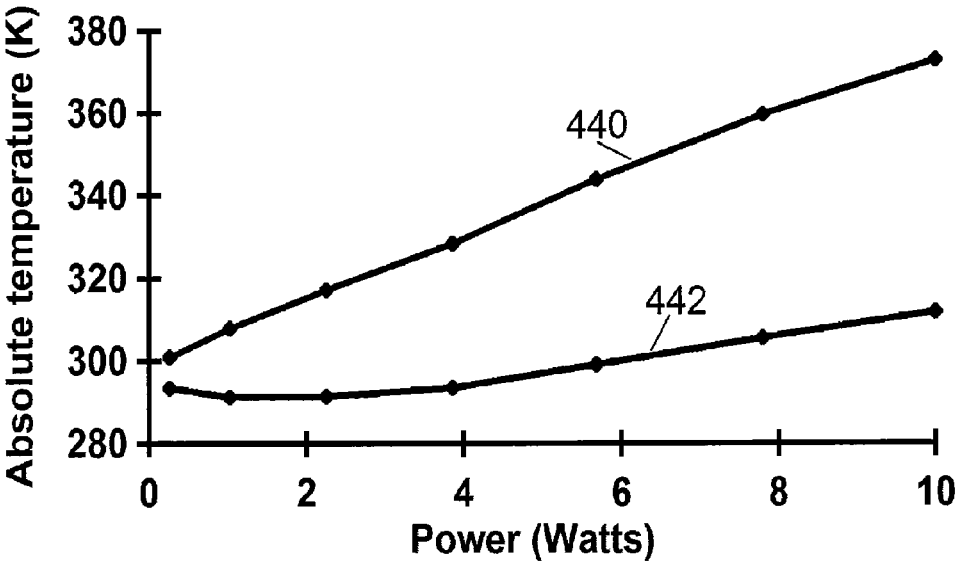
Figure 7A:
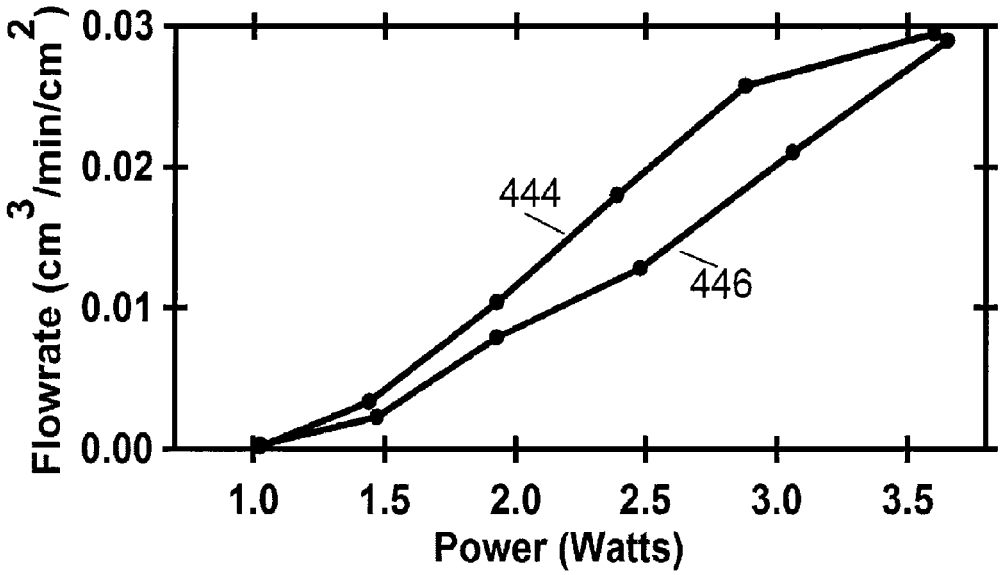
FIGS. 7*a* and 7*b* are illustrations of the measured flow rate for forward and reverse flow through the nanoporous article of the thermoelectric Knudsen pump for the lateral design example (7*a*) and the radial design example (7*b*).
Figure 7B:
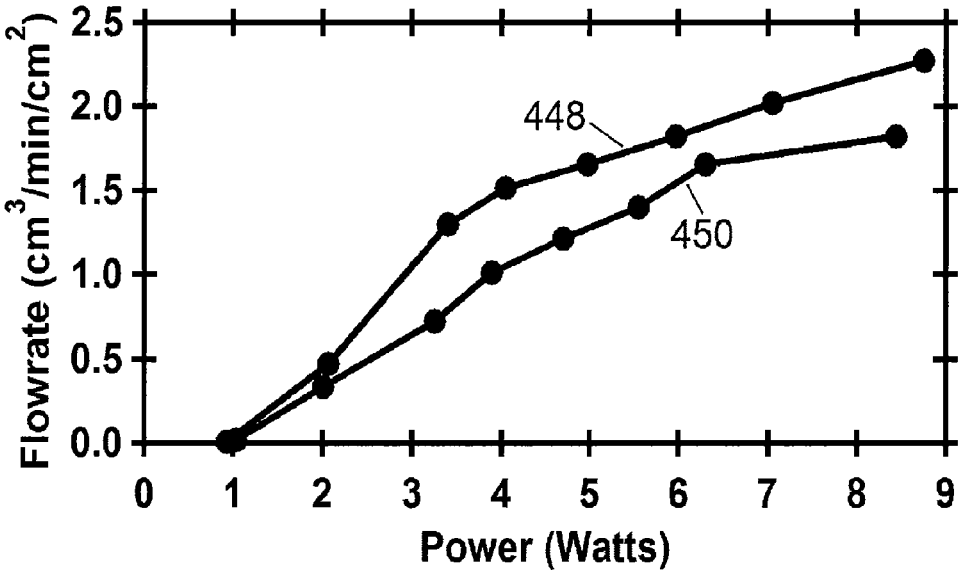

Thermocouples attached to the metal plates are used to measure the temperature of the hot and cold sides as a function of thermoelectric power. FIG. 6*a* shows the temperature of the first (hot) side 436 and of the second (cold) side 438 versus thermoelectric power for the lateral pump design example. FIG. 6*b* shows the temperature of the first (hot) side 440 and of the second (cold) side 442 versus thermoelectric power for the radial pump design example. The normalized flow rate as a function of power consumption is shown in FIG. 7*a* for the lateral pump design example for forward flow direction 444 and reverse flow direction and in FIG. 7*b* for the radial design example for forward flow direction 448 and reverse flow direction 450. The maximum normalized flow rate for the lateral pump design is 0.03 $cm^3/min/cm^2$, and the maximum normalized flow rate for the radial pump design is 2.3 $cm^3/min/cm^2$ which is a flow rate of 0.74 $cm^3/min$.

Figure 8:
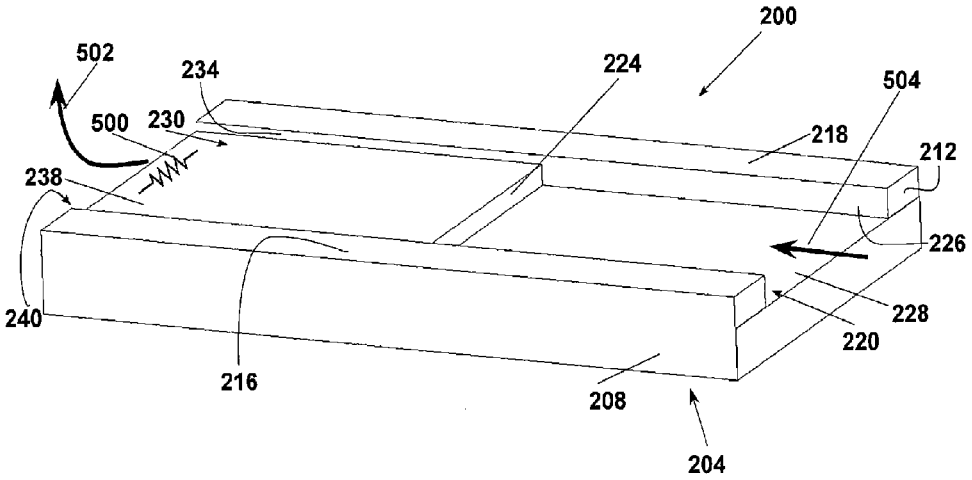
FIG. 8 is a schematic of an example of the second embodiment of the present invention illustrating the Knudsen pump in series with a channel through which liquids shall be pumped.
Figure 9:
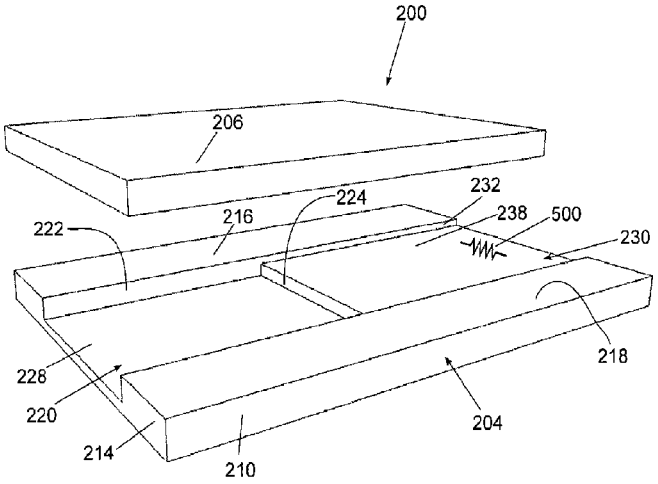
FIG. 9 is a schematic of an example of the second embodiment of the present invention illustrating the Knudsen pump in series with a channel through which liquids shall be pumped.
Figure 10:
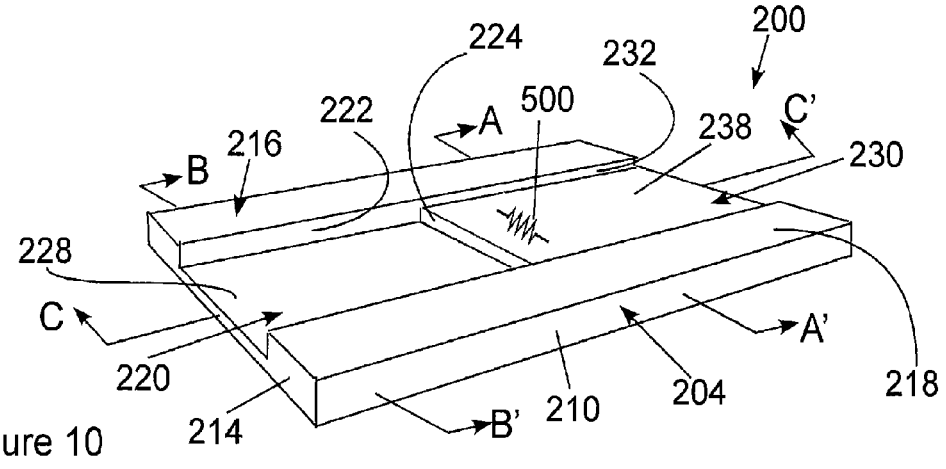
FIG. 10 is a schematic of another example of the second embodiment of the present invention illustrating the Knudsen pump in series with a channel through which liquids shall be pumped.

A second embodiment of the thermally driven pump of the present invention utilizes a Knudsen pump integrated in a lab-on-chip environment. Referring now to FIGS. 8, 9, and 10, the integrated Knudsen pump 200 of a second embodiment of the present invention may be comprised of microscopic glass, plastic, ceramic or silicon slides, wafers or sheets. It is contemplated that the integrated Knudsen pump 200 may be comprised of any material usable as a substrate in a lab-on-chip environment. Some factors to consider when choosing a substrate are cost, ease of fabrication, good thermal isolation between hot and cold sides and flexibility in integrating the pumps 200 with other lab-on-chip devices.

The integrated Knudsen pump 200 is comprised of a bottom substrate 204 and a top substrate 206. The primary components of the integrated Knudsen pump 200 are the two interconnected shallow channels that are fixed into the bottom substrate 204, for example by etching, wherein the depth of the shallow channel 220 is greater than the depth of the nanochannel 230. The shallow channel 220 is comprised of a shallow channel first sidewall 222, a shallow channel rear wall 224, a shallow channel second sidewall 226 and a shallow channel bottom wall 228. The nanochannel 230 is comprised of a nanochannel first sidewall 232, nanochannel second sidewall 234 and a nanochannel bottom wall 238. Creation of the two interconnected channels 220, 230 results in the top wall of the bottom substrate 204 having a bottom substrate top wall first portion 216, a bottom substrate top wall second portion 218, a bottom substrate nanochannel face sidewall 212 and a bottom substrate shallow channel face sidewall 214. The top substrate 206 is affixed to the bottom substrate 204 thereby enclosing the nanochannel 230 and shallow channel 220. The shallow channel rear wall 224 is adjacent the nanochannel 230. The opposite terminal end 240 of the nanochannel 230 is connected to a gas supply, for example it is open to the atmosphere or connected to a gas reservoir, such that air or gas can be drawn into or out of the pump 1 at the terminal end 240. During operation of the pump 200, fluid flows into the shallow channel 220 and not the nanochannel 230, which would otherwise fill due to the capillary forces.

Figure 10A:
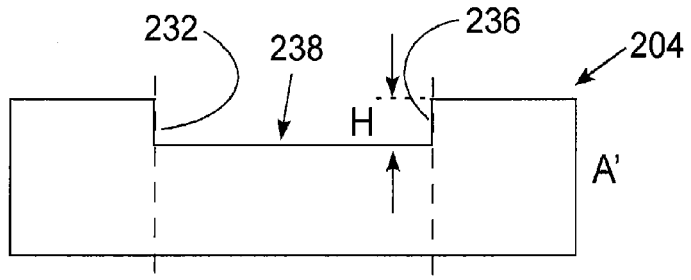
FIG. 10*a* is a first cross sectional view of the pump illustrated in FIG. 10.
Figure 10B:
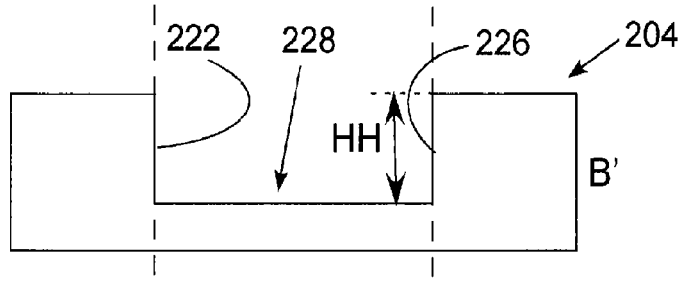
FIG. 10*b* is a second cross sectional view of the pump illustrated in FIG. 10.
Figure 10C:
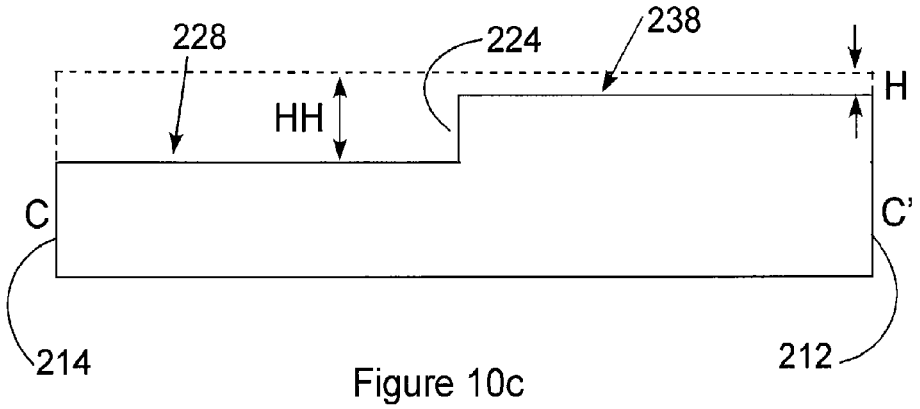
FIG. 10*c* is a third cross sectional view of the pump illustrated in FIG. 10.

FIGS. 10A, 10B and 10C illustrate cross sectional views of the bottom substrate 204, illustrating in FIG. 10A a cross section of the bottom substrate 204 on the nanochannel 230 portion thereof, where the height H of the nanochannel is illustrated and the nanochannel first sidewall 232, the nanochannel second sidewall 234 and the nanochannel bottom wall 238 are illustrated. FIG. 10B is an illustration of a cross section of the bottom substrate 204 on the shallow channel 220 portion thereof, where the height HH of the shallow channel 220 is illustrated and the shallow channel first sidewall 222, the shallow channel second sidewall 226 and the shallow channel bottom wall 228 are illustrated.

The pumping of liquid inside the shallow channel is mainly attributed to the thermal transpiration phenomenon well know by those of ordinary skill in the pertinent technology. However, in a micro scale, there are other forces that have to be balanced in order to obtain favorable pumping action. The dynamic behavior of the meniscus is acted upon by gravitational force, viscous force, interfacial force, the inertial force and the force due to the pressure difference caused by thermal transpiration. The height of water that can be supported by the capillary forces is given by the following formula:

$$h = \frac{2\gamma\cos\theta}{\rho g d}$$

where 'γ' is the surface tension of the liquid, 'θ' is the contact angle with the wall, 'ρ' is the density of the liquid, 'd' is the hydraulic diameter of the capillary and 'g' is the gravitational constant. The integrated Knudsen pump 200 will generate pressure within the channels 220, 230. When the ambient pressure 'Pamb' and the pressure within the channel 'Pch' are measured, the following relationship can be found:

$$P_{ch} = P_{amb}\sqrt{\frac{T_{ch}}{T_{hot}}}$$

where 'Tch' is the temperature at the boundary 224 between the shallow channel 220 and the nanochannel 230 and 'Thot' is the temperature measured at the hot end 236 of the nanochannel 230. The pressure on the fluid in the channels 220, 230 due to the integrated Knudsen pump 200 is the difference between the ambient pressure on the fluid reservoir (not shown) 'Pamb' and the pressure in the channel 'Pch'. This relationship of ambient pressure on the fluid and the pressure in the channels is represented by the following formula:

$$P_{pump} = P_{amb} - P_{amb}\sqrt{\frac{T_{ch}}{T_{hot}}}$$

At equilibrium, the sum of all the pressures on the fluid is zero. This phenomenon is represented by the following formula:

$$\Sigma P = 0 = P_{pump} + P_{cap} - P_{grav}$$

where 'Pcap' represents the capillary pressure and 'pgrav' represents the gravitational pressure acting on the fluid. In some embodiments, a hydrophilic surface may not be undesirable as the capillary forces and the forces generated due to thermal transpiration act in the same direction. Thus a hydrophobic treatment is implemented on the shallow and nanochannel 220, 230 surfaces in order to reduce the capillary forces. With a hydrophobic surface, the capillary height is still beyond that which will be achieved with a micro fabricated device. Using a channel length that is less than the capillary height determined by the above height formula will result in all the water being repelled from the nanochannel 230. Thus an initial 'height' may be assumed to be the (negative) depth that the channel is submerged in a liquid reservoir.

The minimum temperature required to equate the capillary force with the pneumatic force can be found, using the sum of all pressures equation. It is given by the following formula, which in this embodiment, shall be termed threshold temperature 'Tthreshold':

$$T_{threshold} = \frac{P_{amb}^2 T_{ch}}{\left(P_{amb} + \frac{2\gamma\cos\theta}{d} - \rho g h\right)^2}$$

Figure 11:
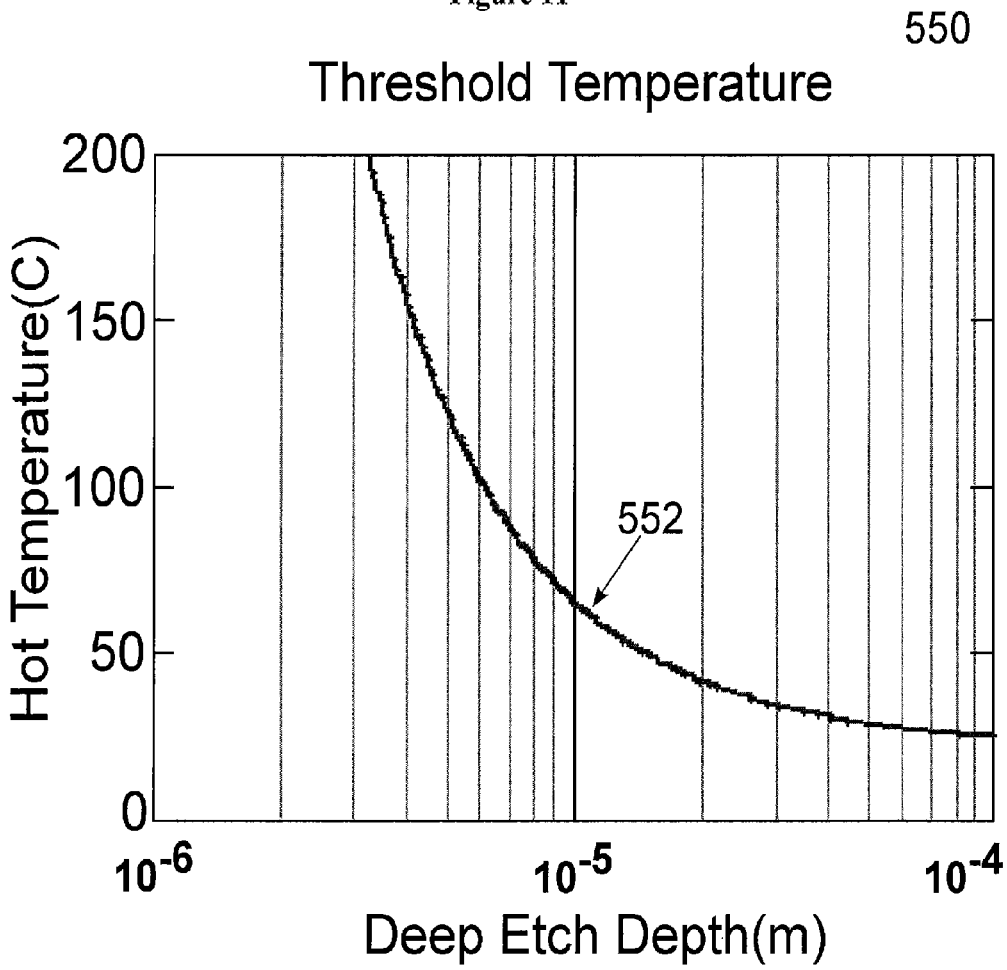
FIG. 11 is an illustration of the variation of the temperature along the channel through which liquid shall be pumped of the second embodiment.

Assuming that the cold temperature is room temperature, and assuming 'height' is nearly zero, the variation of threshold temperature 550 illustrated in FIG. 11 may be obtained. In order for the integrated Knudsen pump to function, a temperature gradient within the channels is required. FIG. 11 illustrates the temperature gradient within the channels, showing the change in temperature along the channel resulting from measurements along the channel during operation of a functioning integrated Knudsen pump in one embodiment of the present invention. As illustrated in FIG. 11, temperature higher than the threshold temperature 552 will start to pump the fluid through the shallow channel 220. As illustrated in FIG. 11, it is apparent that a threshold temperature of 65° C. is required in order to raise the fluid through a micro reservoir of depth 10 μm for the embodiment illustrated.

Figure 12:
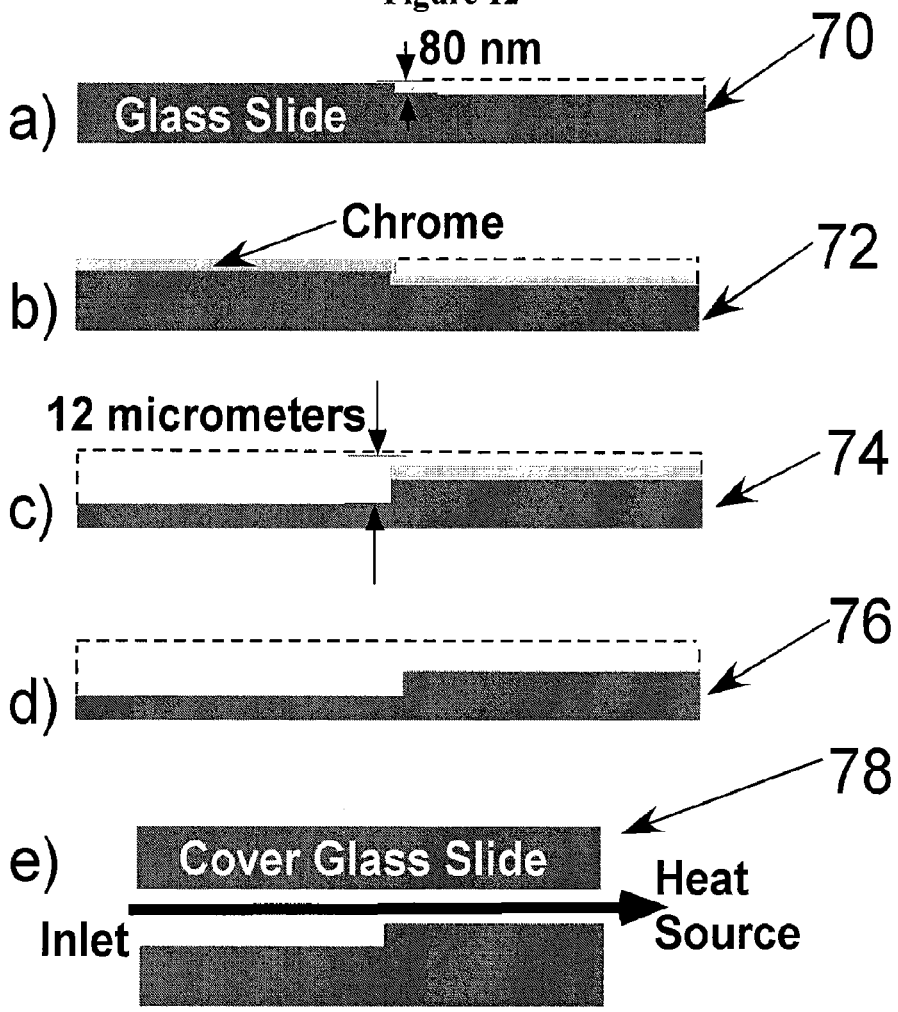
FIG. 12 is an illustration of a fabrication process flow for fabricating the second embodiment of the present invention using a microscopic slide.
Figure 13:
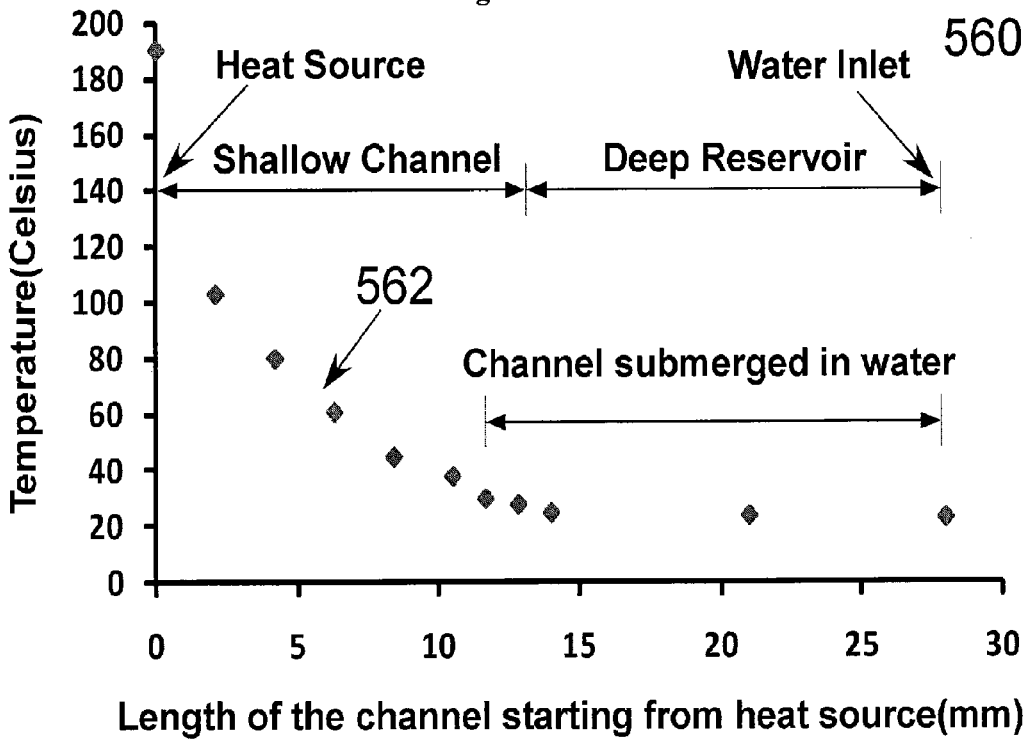
FIG. 13 is an illustration of temperature measurements along the channel through which liquids shall be pumped under thermal transpiration of the second embodiment of the present invention.

The fabrication process for development of the integrated Knudsen pump 200 of one embodiment is performed using microscopic glass slides involving two masks. The microscopic glass slides were pre cleaned using acetone and methanol in order to remove any organic contaminants. The slides were rinsed in DI water followed by the nanostrip treatment at 90° C. for 15-20 minutes. The nanostrip used in this embodiment is manufactured by Cyantek Corporation, of Freemont Calif. This step ensures that the slides are devoid of any organic contaminants that have survived acetone bath. The nanostrip treated slides were DI water rinsed and spin dried. Dehydration baking at 150° C. for 30 minutes would ensure that the slides are moisture free. S1813 photoresist was spin coated onto the glass slides. The slides were exposed with the first mask, defining the nanochannel 230 region. A short oxygen plasma descum was carried out in order to remove any organic residue from the nanochannel 230 defined regions. A dilute BOE treatment of these glass slides creates the nanochannels 230 with 75 nm-80 nm step height. This is shown in FIG. 12 at step (a) 70. The glass slides with the narrow channels 230 were subjected to acetone and methanol rinse followed by the nanostrip treatment. This removes the residue from the hard baked photoresist from the first mask process. After the dehydration bake the slides are sputtered with Chrome, step (b) 72.

A second mask step is implemented on the patterned glass slides with the etched nanochannels. The second mask defines the regions of the deep micro reservoirs. Chrome is etched from these regions with the photoresist as the mask exposing the underlying glass for the prolonged BOE etch. Micro reservoirs are formed during the prolonged BOE etch. The shallow channels 230 are protected by the hard baked photoresist and Chrome as shown in step (c) 74. The hard baked photoresist and Chrome are completely removed for the subsequent glass-glass bonding which is depicted in step (d) 76. The glass slide with shallow channels and deep micro reservoirs are coated with hydrophobic coating in the molecular vapor deposition system. The monolayer coating was performed using FDTS (Perfluorodecyltrichlorosilane) at a pressure of 0.5 Torr along with water maintained at the pressure of 18 Torr. The total time of deposition is 300 sec. The temperature of the chamber is maintained at 35° C. during the deposition. A low temperature glass-glass bonding was adopted in order to obtain the embedded nanochannels. The bottom glass slide with the etched channels and reservoirs is bonded to the top glass slide, which acts as the cover glass.

The bottom glass slide and the top glass slide, illustrated in FIG. 12 as 78, undergo calcium acetate pretreatment in order to activate the surface before bonding. The pretreated slides are hand pressed against each other and placed on a contact hot plate for two hours, maintained at a temperature of 60° C. The temperature of the hot plate may then be raised to 300° C. with the ramp up rate of 100° C. per hour. The dwell time at 300° C. is followed two hours, followed by the ramp down rate of 100° C. per hour. The cross section of the schematic of the bonded glass slides is shown step (e) 78 of FIG. 12.

Referring now to FIGS. 8 and 9, the pumping aspect of the integrated Knudsen pump 200 is enabled by heating the device with a heater 500. Generally, in a lab-on-chip environment, heat would be applied by placing a resistive element, for example wire, in proximity to the heater position in the nanochannel 230 and then running current through the resistive element. Those of skill in the art will recognize that there are many means available for applying heat to the nanochannel 230. In one embodiment, the heater 500 is positioned at the terminal end of the nanochannel 240 (FIGS. 11 and 12). When the heater is heating, gas such as air flows towards the heater via thermal transpiration. In this embodiment, air 502 exits the pump 800 at the terminal end 240 and pressure drops at the boundary 224 between the nanochannel 230 and shallow channel 220 creating a suction that pulls liquid 504 through the shallow channel 220 towards the nanochannel 230.

In another embodiment, the heater 500 is positioned at the boundary 224 between the nanochannel 230 and shallow channel 220 (FIG. 10). When the heater is heating, gas such as air flows toward the boundary 224 and the pressure drops at the terminal end 240 creating a suction that pulls air into the nanochannel from the atmosphere through the terminal end 240. Air leaving the nanochannel at the boundary 224 enters the shallow channel 220 and pushes the liquid in the shallow channel 220 away from the nanochannel 230.

FIG. 16 shows the measured thermocouple readings which depicts the established thermal gradient across the narrow channel 230 for an embodiment where the shallow channel 220 is 12 micrometers deep and the nanochannel 230 is 80 nanometers deep. From FIG. 16, the temperature at the hot channel end 236 on the bottom substrate 204 is 190° C., but drops to 100° C. at approximately 2 millimeters from the hot channel end 236. The temperature further drops to 20° C. at the intersection of shallow and nanochannels (shallow channel rear wall) 224. The temperature difference of $\Delta T=170°$ C. between the shallow channel rear wall 224 and the end 240 of the nanochannel 230 generates a pressure difference due to thermal transpiration. This ultimately causes the increase in the level of the fluid in the shallow channel 220.

The fabricated pump of the embodiment described of the second embodiment of the present invention required two masks to fabricate, and a hydrophobic coating is used to counter capillary forces within the micro fluidic channels in some embodiments. The pump 200 shown in FIGS. 8 and 9 has no moving parts and can be readily integrated with other lab-on-chip channels and components. The fabrication process described in FIG. 12 is in the context of a stand alone Knudsen pump. It is contemplated that the Knudsen pump of the present invention may be created within the substrate of the lab-on-chip device. Accordingly, by creating an integrated Knudsen pump within the lab-on-chip substrate along with the other etched channels for that are configured to drive liquids in a micro fluidics environment, the integrated Knudsen pump may be created using the same technology used to make all other channels within the substrate of the lab-on-chip device at the same time. The top substrate 206, which completes the shallow and nanochannels (220, 230) is glued or bonded to the bottom substrate 204 after being positioned over the first and nanochannels (220, 230). In addition to creating Knudsen pumps integrated into a lab-on-chip device by etching, it is contemplated that the pumps may be created by injection molding, stamping and other methodologies available for creating channels on substrates in a micro fluidics environment simultaneously with the creation of other channels within a substrate. An advantage of creating the Knudsen pump in this manner is that it is much more efficient. In addition, reliability of the pumps in a lab-on-chip environment is improved because there are no moving parts to the pump.

Figure 14:
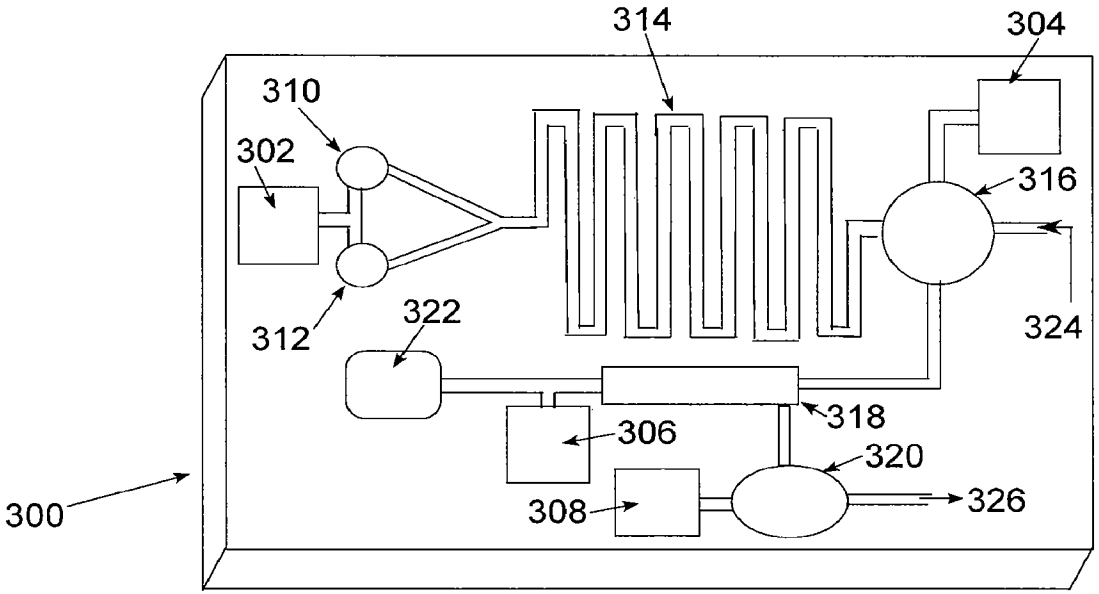
FIG. 14 is a schematic representation of a lab-on-chip integrating the second embodiment of the present invention.

An sample embodiment of a lab-on-chip device 300 is shown in FIG. 14 for illustrative purposes and does not have any particular application. It is being illustrated to show the environment in which the present invention may operate. In typical lab-on-chip devices 300, there may be the need to utilize a pump in order to mix liquid samples that are placed at different entry points. In the embodiment illustrated, a first sample may be placed in a first entry point 310 and a second sample may be placed in a second entry point 312. The first and second entry points 310, 312 are connected to a first pump 302 that facilitates driving the liquid samples from the first entry point 310 and the second entry point 310 through meandering channels 314. From the meandering channels 314, the liquid samples are pumped into a mixing chamber 316 to which a second pump 304 is connected. Pump 304 facilitates the pumping of the liquid exiting the mixing chamber 316 into a separator 318, which in some embodiments may perform as a physical filter. Waste may be deposited in a waste receptacle 320 and a third pump 308 pumps waste from the waste receptacle 320 to an outlet channel 326. The portion of the liquid exiting the mixing chamber that has been separated that needs to be tested is pumped from the separator 318 to a detector 322 by a fourth pump 306. In such an embodiment as that illustrated in FIG. 14, the pumps 302, 304, 306, 308 shall be Knudsen pumps of the type illustrated in FIGS. 8, 9, and 10, capable of pumping liquids. Pumps 302 and 304 are configured to push liquids away from the pumps 302 and 304 through the channels on the lab-on chip. Pump 322 is configured to pull liquids through the channels on the lab-on-chip towards the pump 322. Pump 308 is configured to both push liquids away from and pull liquids towards the pump 308 through the channels on the lab-on-chip.

It is contemplated that the present invention, when utilized in a lab-on-chip environment such as that illustrated in FIG. 14, can be utilized to perform some type of assaying. For example, in a doctor's office, if a blood test needs to be performed, a drop of blood may be collected and placed on top of the lab-on-chip device. The Knudsen pumps within the chip would draw the blood into the channels 314 and pump the blood around though the different stages within the lab-on-chip device. The lab-on-chip device 300 is configured with an injector 324 that allows for the injection of substances that the blood may react with, for example stains etc., which all may be mixed together in the mixing chamber 316. The mixed substance would then be pumped through the separator 318 and into a detector 322 to detect whether the patient has an illness, bacteria, etc. Typically, this system is used to run a sample though this system and then modify the sample so that it can be tested. The lab-on-chip device in which the present invention shall be used has application to break up cells and extract DNA or perform other tests.

Reference may be made throughout this specification to "one embodiment," "an embodiment," "embodiments," "an aspect," or "aspects" meaning that a particular described feature, structure, or characteristic may be included in at least one embodiment of the present invention. Thus, usage of such phrases may refer to more than just one embodiment or aspect. In addition, the described features, structures, or characteristics may be combined in any suitable manner in one or more embodiments or aspects. Furthermore, reference to a single item may mean a single item or a plurality of items, just as reference to a plurality of items may mean a single item. Moreover, use of the term "and" when incorporated into a list is intended to imply that all the elements of the list, a single item of the list, or any combination of items in the list has been contemplated. One skilled in the relevant art may recognize, however, that the invention may be practiced without one or more of the specific details, or with other methods, resources, materials, etc. In other instances, well known structures, resources, or operations have not been shown or described in detail merely to avoid obscuring aspects of the invention.

While example embodiments and applications of the present invention have been illustrated and described, it is to be understood that the invention is not limited to the precise configuration and resources described above. Various modifications, changes, and variations apparent to those skilled in the art may be made in the arrangement, operation, and details of the methods and systems of the present invention disclosed herein without departing from the scope of the claimed invention.

The above specification, examples and data provide a description of the manufacture and use of the invention. Since many embodiments of the invention can be made without departing from the spirit and scope of the invention, the invention resides in the claims hereinafter appended.

What is claimed is:

1. A thermoelectric pump comprising:

a nanoporous article for transferring fluid by thermal transpiration having a first end and a second end, and at least one nanochannel traversing said nanoporous article from said first end to said second end;

a first heat transfer plate adjacent said first end of said nanoporous article creating a first air gap between said first heat transfer plate and said nanoporous article to distribute fluid across the first end of the nanoporous article;

a second heat transfer plate adjacent said second end of said nanoporous article creating a fluid across the second end of the nanoporous article;

a first port for transporting fluid capable of being connected to a reservoir adjacent to said first air gap;

a second port for transporting fluid capable of being connected to a reservoir adjacent to said second air gap;

a thermoelectric device intermediate to the first heat transfer plate and the second heat transfer plate for inducing a temperature gradient across the nanoporous article, said thermoelectric device having a top in contact with the first heat transfer plate and a bottom in contact with said second heat transfer plate such that heat is transferred between the respective sides of the thermoelectric device and nanoporous article across the heat transfer plates;

a power supply electrically connected to a first electrical connector and a second electrical connector of the thermoelectric device such that a temperature gradient is induced across the thermoelectric device when voltage is applied, wherein said first electrical connector is attached to said top of the device, said second electrical connector is attached to said bottom of the device, and said first connector is electrically connected to said second connector by a circuit that traverses said thermoelectric device from said top to said bottom at least once;

a first terminal of said power supply electrically connected to said top of said thermoelectric device and a second terminal of said power supply electrically connected to said bottom of said thermoelectric device such that when the circuit is closed and voltage applied, current flows through the thermoelectric device from said top to said bottom and heat is transferred from said bottom to said top creating a temperature gradient across said thermoelectric device;

said top of said thermoelectric, device heating said first heat transfer plate by conduction and said bottom of said thermoelectric device cooling said second heat transfer plate by conduction; and said first heat transfer plate actively heating said second end of said nanoporous article by conduction and said second beat transfer plate actively cooling said first end of said nanoporous article by conduction thereby creating a temperature gradient across said nanoporous article and inducing a pressure differential across said nanochannels resulting in forward fluid flow from said first port to said second port by thermal transpiration.

2. The thermoelectric pump of claim 1 wherein: a side of the thermoelectric device is adjacent to as side of said nanoporous article.

3. The thermoelectric pump of claim 1 wherein: the thermoelectric device is an annular ring, having an open center and the nanoporous article is concentrically aligned with the device and positioned within the open center such that the sides of the article are encircled by the device.

4. The thermoelectric pump of claim 1 wherein: the at least one nanochannel has a hydraulic diameter of about 100 nanometers or less.

5. A thermoelectric pump comprising:

a nanoporous article for transferring fluid by thermal transpiration having a first end and a second end, and at least one nanochannel traversing said nanoporous article from said first end to said second end;

a first heat transfer plate adjacent said first end of said nanoporous article creating a first air gap between said first heat transfer plate and said nanoporous article to distribute fluid across the first end of the nanoporous article;

a second heat transfer plate adjacent said second end of said nanoporous article creating a second air cap between said second heat transfer plate and said nanoporous article to distribute fluid across the second end of the nanoporous article;

a first port for transporting fluid capable of being connected to a reservoir adjacent to said first air gap;

a second port for transporting fluid capable of being connected to a reservoir adjacent to said second air gap;

a thermoelectric device intermediate to the first heat transfer plate and the second heat transfer plate for inducing a temperature gradient across the nanoporous article, said thermoelectric device having a top in contact with the first heat transfer plate and a bottom in contact with said second heat transfer plate such that heat is transferred between the respective sides of the thermoelectric device and nanoporous article across the heat transfer plates;

a power supply electrically connected to a first electrical connector and a second electrical connector of the thermoelectric, device such that a temperature gradient is induced across the thermoelectric device when voltage is applied, wherein said first electrical connector is attached to said top of the device, said second electrical connector is attached to said bottom of the device, and said first connector is electrically connected to said second connector by a circuit thin traverses said thermoelectric device from said top to said bottom at least once;

a first terminal of said power supply electrically connected to said top of said thermoelectric device and a second terminal of said power supply electrically connected to said bottom of said thermoelectric device such that when the circuit is closed and voltage applied, current flows through the thermoelectric device from said bottom to said top and heat is transferred from said top to said bottom creating a temperature gradient across said thermoelectric device;

said bottom of said thermoelectric device heating said second heat transfer plate by conduction and said top of said thermoelectric device cooling said first heat transfer plate by conduction; and said second heat transfer plate actively heating said first end of said nanoporous article by conduction and said first heat transfer plate actively cooling said second end of said nanoporous article by conduction thereby creating a temperature gradient across said nanoporous article and inducing a pressure differential across said nanochannels resulting in reverse fluid flow from said second port to said first port by thermal transpiration.

6. The thermoelectric pump of claim 5 wherein: a side of the thermoelectric device is adjacent to a side of said nanoporous article.

7. The thermoelectric pump of claim 5 wherein: the thermoelectric device is an annular ring having an open center and the nanoporous article is concentrically aligned with the device and positioned within the open center such that the sides of the article are encircled by the device.

* * * * *